US006049658A

United States Patent [19]

Schave et al.

[11] Patent Number: 6,049,658

[45] Date of Patent: Apr. 11, 2000

[54] FLEXIBLE HOSE FOR A FLOWABLE MATERIAL APPLICATOR

[75] Inventors: Floyd D. Schave, Mesa; Donald L. Timme, Avondale, both of Ariz.

[73] Assignee: Crafco, Incorporated, Chandler, Ariz.

[21] Appl. No.: 08/877,170

[22] Filed: Jun. 17, 1997

Related U.S. Application Data

[63] Continuation-in-part of application No. 08/670,332, Jun. 25, 1996, Pat. No. 5,832,178.

[51] Int. Cl.[7] ..... F24H 1/18

[52] U.S. Cl. ..... 392/472; 392/471; 219/426

[58] Field of Search ..... 392/472, 466, 392/473; 219/202, 420–422, 425

[56] References Cited

U.S. PATENT DOCUMENTS

| | | | |
|---|---|---|---|
| 3,681,566 | 8/1972 | Sellers . | |
| 4,028,527 | 6/1977 | Thagard, Jr. . | |
| 4,289,954 | 9/1981 | Brognano et al. . | |
| 4,455,474 | 6/1984 | Jameson et al. . | |
| 4,486,149 | 12/1984 | Merkel . | |
| 4,644,134 | 2/1987 | Baker | 219/301 |
| 4,673,002 | 6/1987 | Scanlon et al. | 138/149 |
| 4,692,028 | 9/1987 | Schave | 366/22 |
| 4,725,713 | 2/1988 | Lehrke . | |
| 5,093,896 | 3/1992 | Moore et al. | 392/441 |
| 5,366,308 | 11/1994 | Crispino | 401/1 |
| 5,381,511 | 1/1995 | Bahar et al. | 392/472 |
| 5,394,507 | 2/1995 | Okamoto . | |
| 5,428,706 | 6/1995 | Lequeux | 392/472 |
| 5,531,357 | 7/1996 | Guilmette | 222/1 |

FOREIGN PATENT DOCUMENTS

| | | |
|---|---|---|
| 351192 A1 | 10/1986 | Germany . |
| 35 46 275 A1 | 7/1987 | Germany . |
| 36 11 664 A1 | 10/1987 | Germany . |
| 0 391 029 A2 | 10/1990 | Germany . |
| 61-93587 | 5/1986 | Japan . |
| 327116 | 12/1928 | United Kingdom . |
| 725162 | 3/1955 | United Kingdom . |
| 1512033 | 5/1978 | United Kingdom . |

*Primary Examiner*—Mark Paschall
*Assistant Examiner*—Thor S. Campbell
*Attorney, Agent, or Firm*—Nilles & Nilles, S.C.

[57] ABSTRACT

A hot mix applicator having a hose for transporting heated flowable material, preferably hot mix material, that has an outer casing telescoped over a flexible inner conduit. Slidably, telescopically received within the conduit is tubing comprised a single strip of thin metal helically coiled such that adjacent edges engage to form axially compressible tubing which limits bending to resist conduit kinking and crush. The conduit is attached at each end to a fitting assembly with each fitting assembly immovably fixed by an outer collar to the casing for transmitting hose tension through the casing and away from the more fragile conduit. The casing is comprised of a rubber sidewall reinforced with wire for resisting kinking, crushing, and twisting. Preferably, there is a gap between the casing and conduit that helps insulate the conduit. Each fitting assembly preferably includes a swivel fitting at least partially received within the casing to insulate it. To heat flowable material within the tubing, heat element wiring is wrapped in a spiral around the conduit substantially the length of the hose. The collar overlies a bore in the casing through which the heat element wiring enters the hose for preventing the casing from splitting at the bore when it flexes and bends.

50 Claims, 10 Drawing Sheets

FLEXIBLE HOSE FOR A FLOWABLE MATERIAL APPLICATOR

CROSS REFERENCE TO RELATED APPLICATION

This application is a continuation-in-part of commonly assigned patent application Ser. No. 08/670,332, filed Jun. 25, 1996 that issued Nov. 3, 1998 as U.S. Pat. No. 5,832,178.

FIELD OF THE INVENTION

The invention relates generally to a flexible hose for a flowable material applicator and more particularly to a flexible hose through which a heated flowable material can be connected.

BACKGROUND OF THE INVENTION

Hot melt mix applicators are used to apply hot melt mix, in the form of an asphalt or bituminous hot melt material, on areas such as paved roads and the like for sealing, patching, or repairing the roads. These types of applicators are also used to apply hot melt material to hold in place raised or recessed pavement markers and to seal and protect inductive traffic loops.

In one such commercially successful hot melt mix applicator heretofore marketed by the assignee herein and disclosed in U.S. Pat. No. 4,692,028, the applicator has a tank for heating and storing hot melt mix that is pumped by a pump through a hose and a wand onto pavement. During periods of operation where an operator wishes not to apply mix, but desires the mix to remain hot enough to be applied on demand, the wand is inserted into a holster connected to the tank. With the wand in the holster, the pump continuously circulates mix through the hose, wand, holster and back into the tank so that it will not harden in the wand or hose and obstruct flow.

When use of the applicator is finished, the pump is briefly reversed to clear the hose and wand of hot melt mix material before the hot melt mix is allowed to cool. Unfortunately, should hot melt mix harden within either the hose or the wand, it can partially obstruct or completely block flow through the hose causing an operator to have to clean out the hose and wand before the applicator can be used to apply hot melt mix.

To improve upon this method of preventing obstruction of the hose and wand, a single phase electrical heating system has been used to prevent hot mix material from solidifying in the hose and wand. In operation, a temperature sensor on the wand or hose communicates temperature to a controller which regulates the heat input of a heating element of the system that is in contact with the hose and wand by regulating electric power applied to the element.

In the construction of the heating element, a single heating element wire and a non-heating neutral wire makeup a two-wire heating element cord that is wrapped around the hose and wand in a spiral or helical fashion. Unfortunately, a rather dangerous electric potential of at least about 110 volts A.C. is applied to the heating element during operation to heat the hose and wand. As a result, the risk of shock is great should wires become exposed or otherwise become insufficiently insulated during operation.

Additionally, because only one wire of the pair of wires of the heating element cord wrapped around the hose can generate and transmit heat, the cord must be relatively tightly coiled around the hose and wand with a minimum of space between coils to provide the proper heat flux to prevent the hot melt mix from solidifying. Unfortunately, since only one wire of the two wire heating element cord can generate heat and since both wires of the cord bear against the hose and wand, the amount of heating element wire per unit length of cord is not maximized leading to less efficient heating element operation.

Moreover, for particularly long lengths of hose, such as hoses that are about twelve feet in length or longer, more than one temperature sensor must be used in a single phase heating system to provide adequate temperature regulation so that the hose and wand will be properly heated during operation. This additional sensor disadvantageously increases the cost and potential maintenance of the heating system while it also increases the complexity and difficulty of properly heating both the wand and hose to maintain them at a temperature which will ensure good hot melt mix flow through the hose and wand.

In the control of the heating element, the temperature controller simply regulates current flow from a single phase alternator to the heating element by turning current flow on and off. In determining whether current flow should be supplied, the controller has a selectively adjustable thermostat which communicates with the temperature sensor. If the sensed temperature is too high, the thermostat will cause the controller to turn off current flow to the heating element. If the sensed temperature is too low, the thermostat will cause the controller to turn on current flow to the heating element.

To control single phase current flow, the controller is wired in series with the heating element and simply functions as an on/off switch in response to input from a temperature sensor in communication with the hose or wand. The controller does not control operation of the alternator nor the engine. It simply functions as a switch to turn on and off current flow to the heating element.

The alternator is a conventional alternator that is connected by pulleys and a belt to a drive shaft of an internal combustion engine for supplying electrical power. The alternator has an integral power regulation circuitry to convert its raw three phase lower voltage output into single phase A.C. current having a regulated voltages of at least about 110 volts. Unfortunately, this power regulation circuitry adds to the cost of the system without adding any advantage in its use or operation.

What is needed is a more efficient and economical wand and hose heating system that more safely operates at lower voltages while still providing adequate heat to maintain hot melt mix within the hose and wand at a flowable state. What is also needed is a hot melt mix applicator of relatively compact and mobile construction that has a heated hose and wand for maximizing convenience and performance of the applicator.

SUMMARY OF THE INVENTION

A method and heating system for a hose and wand of a hot melt mix applicator that uses a three phase electrical heating element powered by a selectively energizable generator to heat the hose and wand to maintain hot melt mix material within the hose and wand in a flowable state. To selectively energize the generator to control heat input to the hose and wand, the heating system has (1) a temperature controller in communication with a temperature sensor carried by the hose or wand and (2) a control output in communication with an input of the generator. The control input of the generator enables operation of the generator to be controlled by the temperature controller for controlling current flow to the heating element thereby controlling heating of the hose and wand.

The hot melt mix applicator has a source of hot melt mix material that preferably is contained in a kettle. The kettle preferably is of vertically upstanding, generally cylindrical construction and preferably is of double boiler construction with an envelope between inner and outer sidewalls for receiving hot oil therein to heat hot melt mix inside of the inner wall of the kettle. To enable hot melt mix material to be pumped from the kettle when heated to a flowable state, the applicator has a pump with an inlet received in the kettle and an outlet connected to the hose.

In a preferred applicator embodiment, the kettle has a hot melt mix material pump located in between a pair of agitators within the kettle for agitating hot melt mix material within the kettle during operation. Preferably, the hot melt mix material pump is a hydraulically driven pump coupled to a hydraulic fluid pump that is connected to a drive shaft of a prime mover that preferably is an internal combustion engine.

An output shaft of the engine is also coupled to a generator of electrical power that preferably generates three phase electrical power. Preferably, the generator is a conventional vehicle alternator modified so as not to require any rectifier, voltage regulator, current regulator, or any other electrical power regulation circuitry on board the alternator for directly outputting three phase electrical power to the three phase electrical heating element.

The generator has a stator with three outputs that connect to the hose and wand heating element and a rotor that has a control input for enabling the generator to be selectively energized to control heating of the hose and wand. The control input is connected to a control output of the controller which issues a control current to turn on the rotor when the temperature of the hose or wand drops below a preset temperature.

In a preferred embodiment, the controller has its own power source that preferably is a direct current power source that preferably is a battery. To sense the temperature of the hose or wand, the controller has a pair of inputs connected by wires to the temperature sensor which is affixed to the hose or wand. Preferably the temperature sensor is an RTD thermocouple for sensing the temperature of the hose or wand. Preferably, the temperature sensor is affixed to the hose adjacent the kettle end of the hose. Preferably, the sensor is affixed to the hose about six inches from the kettle end of the hose.

To prevent hot melt mix material from solidifying within both the hose and wand, the three phase heating element is in communication with both the hose and wand. The heating element is comprised of three heating element wires, each wire for carrying a phase of the three phase electrical current from the generator. The wires of the heating element are received in insulating material which spaces each of the wires apart from each other forming a cord. The heating element cord is wrapped in a spiral or helical configuration around a wall of both the hose and the wand. At one end of the heating element cord, each of the wires of the heating element cord are connected to an output terminal of the generator. At the other end of the heating element cord, the ends of each wire are connected to each other. Each wire generates heat when current is applied, with the heating element cord having no non-heating wires or neutral wires in contact with the hose and wand where the heating element is wrapped around the hose and wand.

Preferably, each spiral or coil of the heating element cord is spaced about three quarters of inch from adjacent spirals or coils for producing a heating flux of at least about 2.5 watts per inch$^2$ and preferably produces an optimum heating flux of about 3.5 watts per inch$^2$ when a preferred combination of three phase voltage and current are passed through each heating element wire. Alternatively, adjacent coils of the cord can be spaced apart between about one half inch to about one inch while still producing sufficient heat flux density to achieve proper heating of the hose and wand.

Preferably, the cord is wrapped relatively tightly around the hose and wand so that it bears against the hose and wand to maximize heat transfer from each of the heating element wires to the hot melt mix material within the hose and wand. Preferably, the cord is affixed directly to the hose and wand such as by tape that can be an insulating tape like silicone tape.

The heating element cord of the hose is connected in series with the heating element cord of the wand. To accommodate the hose being connected to the wand, the heating element cord of the hose has a non-heating portion which is connected by an electrical connector to a non-heating portion of the heating element cord of the wand, thereby connecting both cords in series. The connector allows the hose or the wand to be quickly exchanged with another hose or wand, should such a need arise. Preferably, the cord also has a non-heating portion connected by such a connector to a power cord of the applicator adjacent the kettle.

The heating element wire is constructed of a resistance-type heating wire, such as a copper wire, a copper alloy wire, nichrome, an iron-nichrome-aluminum alloy, or another type of wire capable of relatively efficiently generating heat upon the passage of current through the wire. Each of the non-heating portions of the cord is preferably constructed of copper wire having a thickness of preferably at least about fourteen gauge.

In a preferred hose construction, the hose is comprised of an inner wall formed of a strong and resilient material, such as preferably braided stainless steel hose, forming a conduit through which hot melt mix material passes during operation. The inner wall has a layer of silicone that preferably is silicone tape. Overlying this layer of silicone is the three phase heating element cord, which is wrapped in a helical spiral around the silicone layer and inner hose wall. Wrapped around the cord is another layer of silicone that preferably is silicone tape. On its exterior, the hose has a tough, durable, flexible and resilient outer rubber covering that overlies a layer of insulation that preferably can be an open or closed cell insulating foam. The temperature sensor is preferably received in a hollow in the insulation and is urged against the inner hose wall by tape wrapped around the hose. At each end of the hose is a threaded fixture for enabling the hose to be fluidtightly connected at one end to the kettle and at its other end to the wand.

The wand has a gun-type dispenser adjacent its connection with the hose. Extending outwardly from the dispenser gun is a generally rigid and generally cylindrical hollow barrel that forms a hot melt mix flow tube through which the hot melt mix material flows during operation. The heating element cord is wrapped in a spiral or helical configuration preferably around the radially outer surface of the hot melt mix flow tube to maximize heat transfer from the cord, through the tube and to the hot melt mix in the wand. Preferably, the cord is secured against the tube by tape wrapped around the cord and tube or by another means.

To prevent a user from being burned during operation, the wand has a larger diameter outer support tube generally coaxially telescoped over the hot melt mix flow tube. To prevent heat loss and to prevent a user from being burned, insulation can be received in an envelope between the radially outer surface of the hot melt mix flow tube and the radially inner surface of the support tube. To space the tubes apart from each other, there preferably is a spacer cap on the end of the hot melt mix flow tube. To prevent the wand from dripping during operation, the nozzle at the free end of the wand preferably has a duckbill type valve.

The temperature controller has a programmable thermostat-type circuit which is in control with an external control temperature input that is selectable by the user of the hot melt mix applicator. Preferably, the external control temperature input is a knob attached to a shaft of a variable control mechanism, such as a variable resistor, variable capacitor, potentiometer, or another suitable variable control mechanism that can be analog or digital.

During operation, the temperature of the hot mix material in the hose is sensed by the controller and compared with the control temperature to determine whether to energize the generator to supply current to the heating element to heat the hose and wand. If the sensed hot melt mix temperature is above a suitable threshold above the control temperature, the controller will not energize the generator and no heat will be applied to the hose and wand. If, however, the hot melt mix temperature is less than the control temperature or below a threshold less than the control temperature, the controller energizes the generator thereby causing the heating element to heat the hose and wand. To energize the generator, the controller sends a control current from its output to the rotor input of the generator.

In a preferred embodiment of the hose and wand heating system, the controller has a lower setpoint control temperature indexed to the control temperature preset by the user that can be, for example, five degrees, ten degrees, fifteen degrees or another predetermined increment below the control temperature set. Alternatively, the lower setpoint control temperature can be the same as the control temperature set by the user. To determine when to deenergize the generator, the controller has an upper setpoint control temperature that is indexed to the control temperature and which can be a predetermined value of, for example, five degrees, ten degrees, fifteen degrees or another amount greater than the control temperature.

In another preferred controller embodiment, the controller can be constructed and arranged to control engine operation to selectively regulate the power output of the generator to control heating of the hose and wand by the heating element. The controller has an output in communication with an engine controller that preferably can controllably vary the speed of the engine to control generator power output. Preferably, the engine controller is a solenoid coupled to the engine throttle.

In one preferred engine control regimen, the controller senses the voltage, current or power being supplied by the generator to the heating element and adjusts engine speed accordingly. In another preferred control regimen, the controller adjusts engine speed in according to the temperature of the hot melt mix material within the hose or wand.

In a still further control regimen, the controller energizes the generator based upon the hot melt mix temperature sensed by the temperature sensor and controls engine speed while the generator is energized. The generator is preferably selectively energized based upon the sensed temperature and/or the electrical load of the heating element.

In a novel and preferred heated hose construction, the hose comprises a woven or braided tetrafluoroethylene (TEFLON) lined conduit having a compression-resistant flexible tubing slidingly telescopingly received within the conduit that limits how much the conduit can bend, preventing kinking while also resisting crushing of the conduit. A heating element preferably is wrapped around the conduit to heat the heated flowable material within the tubing. The conduit is attached at each end to a fitting, that preferably is a transition fitting, and is encased by an outer protective casing telescoped over the conduit that preferably comprises a rubber hose having relatively stiff reinforcing wire embedded in its sidewall that helps resist bending, crushing and twisting. The wiring preferably comprises a single helical wire within the casing sidewall that forms a crush resistant bellows-like sidewall reinforcement.

The tubing is comprised of a single continuous and elongate thin strip of metal that preferably is aluminum helically coiled with its edges engaged to form a generally cylindrical tube that can be bent, is axially compressible while also providing the conduit with increased crush resistance. To put the tubing in the conduit, the tubing is slidably telescoped into the conduit such that it is at least slightly axially compressed within the conduit to permit bending while limiting how much the conduit can be bent thereby preventing kinking. When received in the conduit, the tubing is slidably movable relative to the conduit to help accommodate bending of the conduit.

The casing extends the full length of the hose and is immovably fixed to a fitting assembly at each end of the hose by a collar that crimps the casing tightly around the fitting assembly. By this construction, the casing transmits hose tension, caused during pulling of the hose, from one hose end to the other hose end away from the conduit thereby minimizing tension transmitted to and through the more fragile conduit.

Each fitting assembly preferably comprises a swivel fitting and the transition fitting. Each collar preferably crimps the casing tightly around a housing of one of the swivel fittings. Each swivel fitting is at least partially received within the casing for insulating it. Each transition fitting is completely received within the casing thereby insulating it. Preferably, within the hose there is an air gap between the casing and conduit that insulates the conduit.

The swivel fitting has a female threaded portion that is threaded onto a male threaded portion of the transition fitting. The other end of the swivel has a male threaded portion which can swivel relative to the housing for permitting the hose to rotate relative to that which it is attached to help prevent twisting of the hose.

The collar is elongate, cylindrical, and overlies a hole in the casing through which the heat element wiring enters the hose for preventing flexure of the casing from rupturing the casing at the bore. The collar also has a bore generally coaxial with the casing hole permitting the heat element wiring to pass through it as well.

Objects, features and advantages of this invention are to provide a hot melt mix applicator hose and wand heating system and method for controlling heat applied to a hose and wand of a hot melt mix applicator which: more efficiently heats the hose and wand using three phase electrical power; simplifies, lessens cost and increases reliability by utilizing a three phase generator that is an off-the-shelf vehicle alternator advantageously not requiring a rectifier or regulator; maximizes heat transfer and achieves more uniform heat flux by utilizing a three phase heating element that does not require a non-heating neutral or return wire; minimizes engine load and better controls heating of the hose and wand by selectively energizing the generator only electrical power is when needed; operates more safely at a lower voltage; and is a hose and wand heating system that has a minimum of components, is rugged, simple, flexible, reliable, and durable, and which is of economical manufacture and which is easy to assemble and simple to use, and a hose for transporting heated flowable material that is flexible yet offering improved kink resistance, is highly crush resistant, is twist resistant, and is a hose which minimizes tension applied to its flexible inner conduit for preventing conduit failure and the conduit pulling free of one or both of its fittings, and is a hose which is durable, rugged, simple and quick to assemble, reliable, easy to use, and which is economical to manufacture.

BRIEF DESCRIPTION OF THE DRAWINGS

These and other objects, features, and advantages of this invention will become apparent from the following detailed description of the best mode, appended claims, and accompanying drawings in which:

DETAILED DESCRIPTION OF THE INVENTION

I. Introduction

Figure 1:
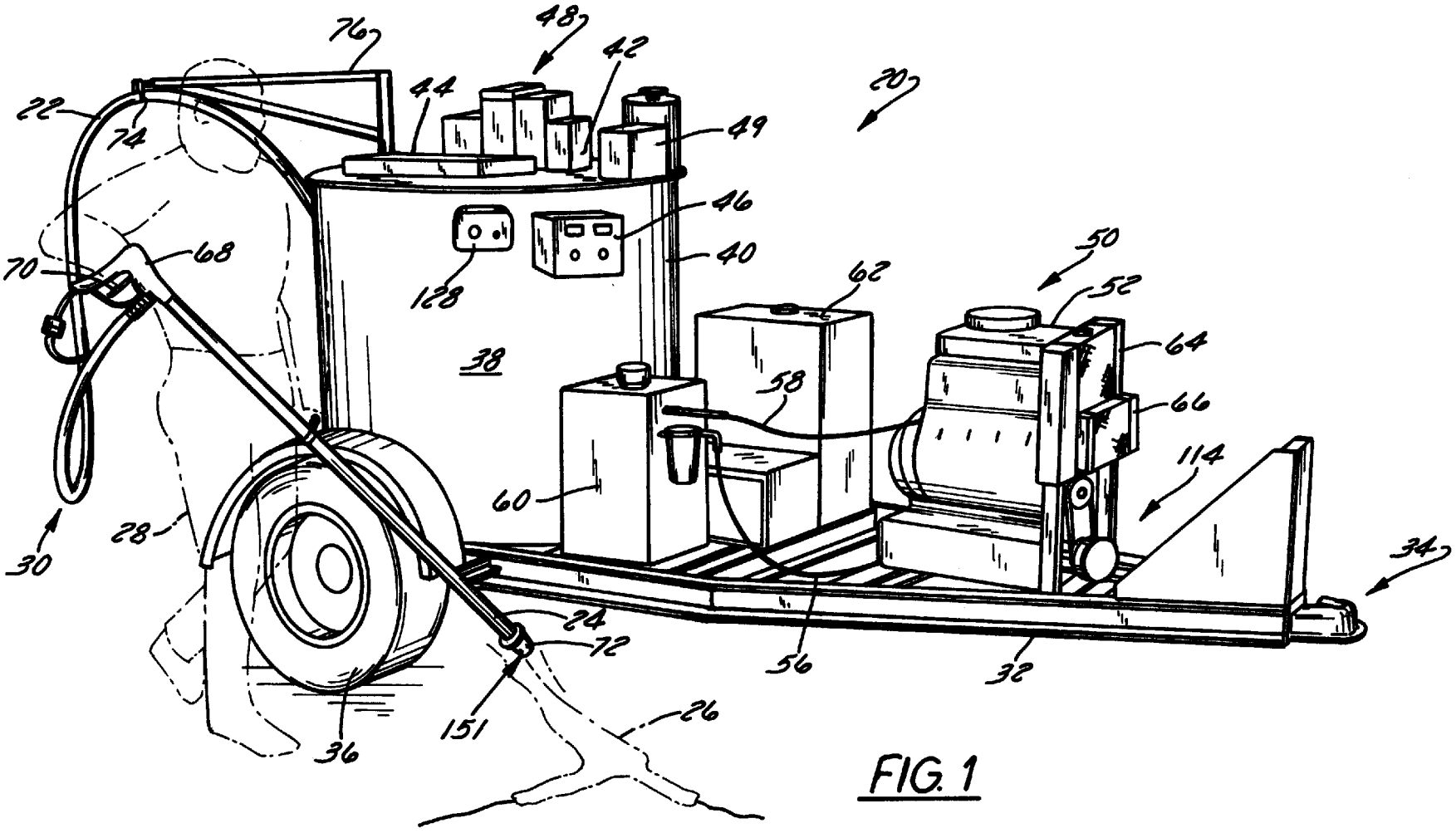
FIG. 1 is a perspective view of a hot melt mix applicator having a hose and wand heating control system of this invention.

FIG. 1 illustrates a hot melt mix applicator 20 that utilizes a heated hose 22 and a heated wand 24 of this invention for controllably dispensing a heated flowable material 26 (in phantom) that preferably is a hot melt material or mixture such as bitumen, tar, an asphalt mixture, a resin, a thermoplastic, or another material capable of being made flowable upon heating to a desired temperature. To more efficiently heat the hose 22 and wand 24 while minimizing the risk and severity of shock to a user 28 (in phantom) of the applicator 20, three phase current of a relatively low voltage is applied to a heating element 30 (FIGS. 4 and 5) in contact with both the hose 22 and wand 24.

II. Hot Melt Mix Applicator

Figure 3:
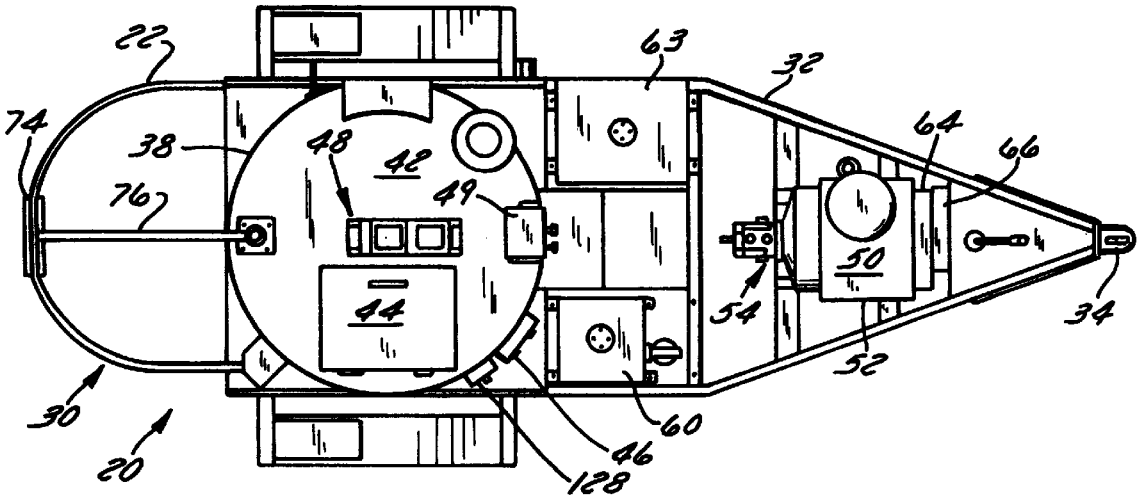
FIG. 3 is a top view of the applicator.
Figure 2:
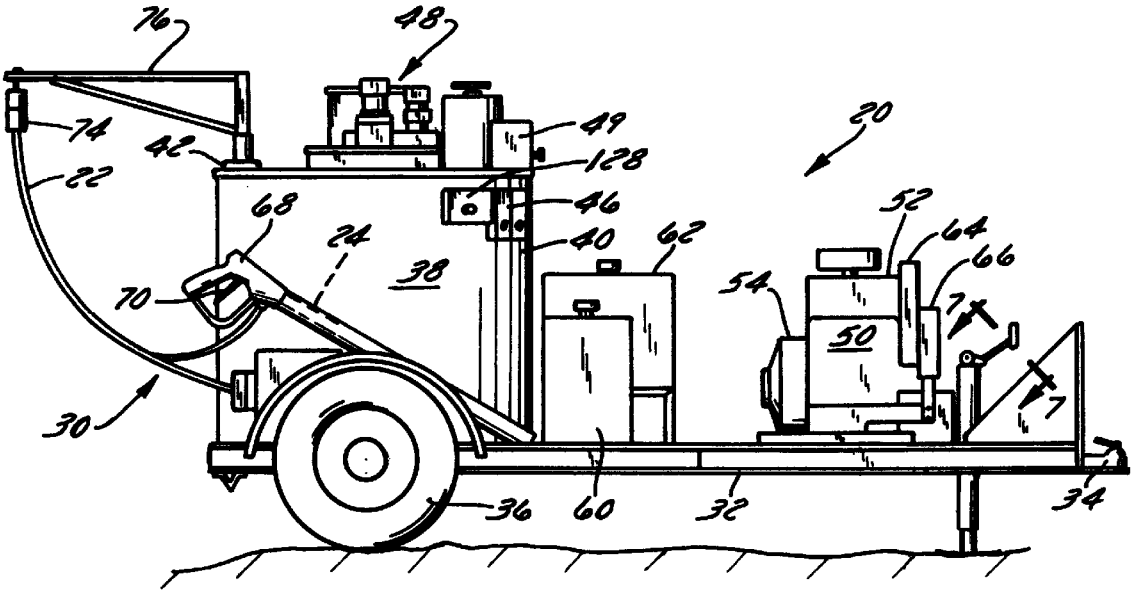
FIG. 2 is a side view of the applicator.

As is shown in FIGS. 1–3, the hot melt mix applicator 20 has a support frame 32 with a vehicle hitch assembly 34 at one end and which is supported on a pair of wheels 36 adjacent its other end. Carried by the frame 32 is a source of heated flowable material that preferably is a mixture of hot melt material received in an insulated and heated kettle 38.

The kettle 38 has a bottom wall, a generally cylindrical side wall 40, a top wall 42 and preferably is vertically upstanding in the manner shown in FIGS. 1–3. Hingedly attached to the top wall 42 is a hatch cover 44 that can be opened to put one or more solid bricks (not shown) of hot melt mix inside the kettle 38. Preferably, the kettle 38 is of double boiler construction having an interior wall spaced apart from the exterior side wall creating an envelope therebetween in which hot oil circulates during operation to heat the hot melt mix within the kettle 38 to or above a temperature at which it becomes flowable. Preferably, the kettle can be constructed and arranged substantially in accordance with the generally cylindrical sealant melting tank disclosed in U.S. Pat. No. 4,159,877, the disclosure of which is hereby expressly incorporated herein.

To heat the oil and the hot melt mix material, one or more heating coils are preferably immersed in the oil. To directly heat the hot melt mix material, one or more heating coils can be located inside the interior wall of the kettle 38 in direct contact with hot melt mix inside the kettle 38. Alternatively, a gas burner (not shown) in the underside of the kettle 38 and which is coupled to a supply of gaseous fuel can be used to heat the oil to, in turn, heat the hot melt mix material.

To selectively control the temperature of the heated oil to ultimately regulate the temperature of the hot melt mix material within the kettle 38, the applicator 20 has a temperature controller 46 in communication with (1) a temperature sensor immersed in the oil to sense directly the temperature of the oil and (2) a temperature sensor in contact with hot melt mix within the kettle 38. As is shown in FIG. 1, the hot melt mix temperature controller 46 preferably is constructed and arranged such that it has a display for displaying the temperature of the oil, a knob below the display for selecting the desired hot oil temperature, another display for displaying the temperature of the hot melt mix material inside the kettle 38, and a knob below it for selecting the desired hot melt mix temperature.

During initial operation, hot melt mix material within the kettle 38 is heated to a temperature of between about 350° F. and about 400° F. so that it will be in a flowable or even a liquified state. However, depending upon the type and nature of the material within the kettle 38 that is to be heated and applied, the hot melt mix material temperature can be greater or lower than the aforementioned range.

When the hot melt mix is heated to a temperature at or above which it becomes flowable, can be pumped, or even is liquified, the hot melt mix inside the kettle 38 preferably is agitated by an agitator and pump assembly 48. Preferably, the agitator and pump assembly 48 has at least one agitator inside the kettle 38 to stir the hot melt mix to help keep it at a more uniform temperature throughout the kettle 38. Additionally, each agitator also helps to keep solids, such as fibers, granules or other particles, suspended in the mixture while it is in a heated and flowable state.

The agitator and pump assembly 48 also includes a pump (not shown) having an inlet in communication with hot melt mix inside the kettle 38 and an outlet in communication with the hose 22 for pumping heated hot melt mix material from within the kettle 38 to the hose 22 and wand 24 for being dispensed from the wand 24. The hot melt mix pump preferably is a hydraulically operated pump that preferably is of gerotor or gear-rotor construction for delivering hot melt mix material from within the kettle 38 to the hose 22 and wand 24. To control operation of the agitators and hot melt mix pump, there preferably is a control panel 49 carried by the kettle 38.

In one preferred embodiment of the hot melt mix applicator 20, the hot melt mix pump is positioned inside the kettle 38 between a pair of spaced apart agitators in the kettle 38 for enabling solids, such as fibers and the like, to remain suspended in heated hot melt mix material within the kettle 38. Preferably, the agitator and hot melt mix pump assembly 48 is constructed and arranged substantially in accordance with a pump and agitator assembly embodiment disclosed in U.S. Pat. No. 4,859,073, the disclosure of which is hereby expressly incorporated herein.

To provide power to operate the hot melt mix pump, the applicator 20 has a prime mover 50 that preferably is an internal combustion engine 52, such as a diesel engine. Alternatively, the prime mover 50 can be a gasoline engine, an electric motor, a hydraulic drive, a pneumatic drive, or another type of power source. As is shown in FIG. 1, operably connected to the engine 52 is a hydraulic fluid pump 54 having an inlet line 56 and a return line 58 in communication with a hydraulic fluid tank 60. To provide fuel for operating the engine 52, the applicator 20 has a fuel tank 62 carried by its support frame 32.

During operation, the engine 52 powers the hydraulic fluid pump 54 which supplies hydraulic fluid under pressure to the hot melt mix pump to cause flowable hot melt mix material to be pumped from the kettle 38 to the hose 22 and wand 24. To cool the engine 52 during operation, the engine 52 has a radiator 64. To cool hydraulic fluid during pump operation, the engine 52 preferably also carries a hydraulic fluid radiator 66.

To control the application of hot melt mix pumped from the kettle 38 to the wand 24 and dispensed from the wand 24, the wand 24 has a gun-type dispenser 68 at one end. To selectively dispense hot melt mix from the wand 24, the dispenser gun 68 has a trigger 70.

In a preferred embodiment of the hot melt mix applicator 20, the trigger 70 communicates directly with the hot melt mix pump to control pump operation for relatively precisely regulating the flow of hot melt mix material from the wand 24. Preferably, when the trigger 70 is depressed, it turns on the hot melt mix pump causing hot melt mix material to be dispensed from the wand 24. When released, the trigger 70 turns the pump off stopping flow to the wand 24 thereby regulating hot melt mix flow through the wand 24 and hose 22. Preferably, the control apparatus for enabling selective dispensing of hot melt mix material in this manner can be constructed and arranged substantially in accordance with the melt mix flow control apparatus disclosed in U.S. Pat. No. 4,692,028, the disclosure of which is hereby expressly incorporated herein.

To minimize and preferably substantially prevent hot melt mix from dripping from the end of the wand 24, the end of the wand 24 preferably has a resilient and flexible duckbill-type valve 72 (FIGS. 1 and 5), that can be of disposable construction. In an alternative embodiment, during operation, the hot melt mix pump can continuously operate to supply hot melt mix under pressure to a wand 24 having a dispenser with a conventional valve that can be selectively opened to dispense hot melt mix material from the wand 24 and closed to stop dispensing hot melt mix material.

III. Hose and Wand Construction

A. Hose Construction

1. Prior Art Hose Construction

As is shown in FIGS. 1–3, the hose 22 is received in a cradle 74 carried by a pivoting swing arm 76 that is attached to the kettle 38 to enable a user 28 of the hot melt mix applicator 20 to more quickly and easily maneuver the hose 22 and wand 24 during operation. The hose 22 is of flexible and resilient construction and is connected to a fitting extending outwardly from the kettle 38 at one end and to the dispenser gun 68 of the wand 24 at its other end.

Figure 4:
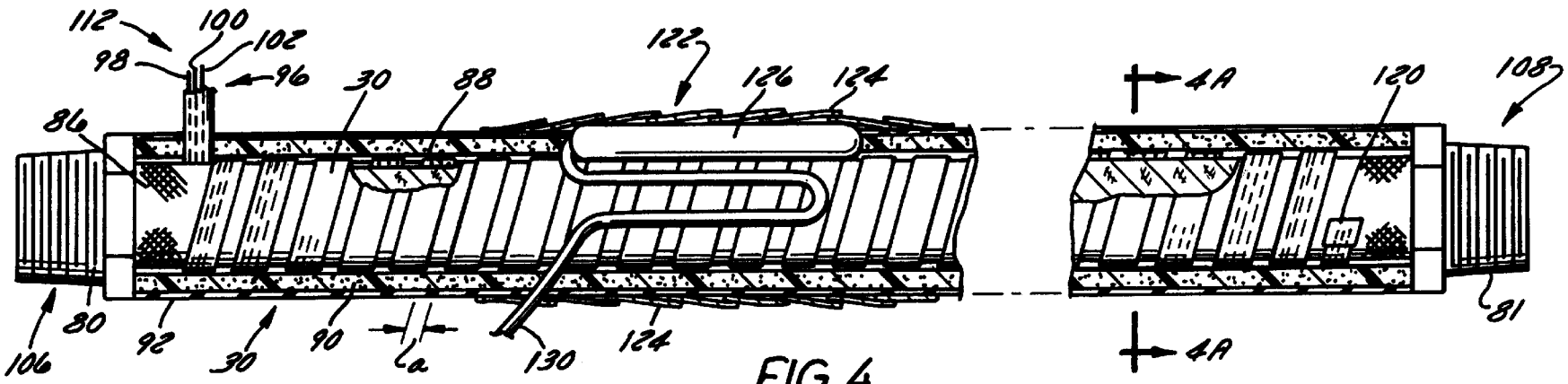
FIG. 4 is a partial fragmentary side view of a hose of the applicator broken away to show its three phase heating element and temperature sensor.
Figure 4B:
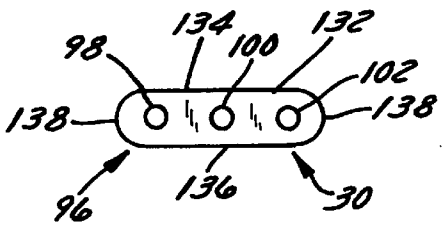
FIG. 4B is a cross sectional view of the three phase heating element cord taken along line 4B—4B of FIG. 4.
Figure 4A:
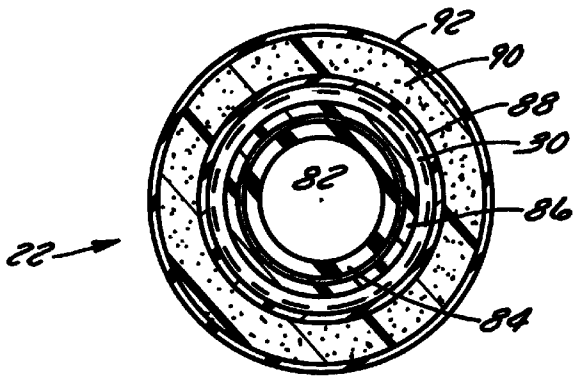
FIG. 4A is a cross sectional view of the hose taken along line 4A—4A of FIG. 4.

As is shown in FIGS. 4 and 4A, the hose 22 is elongate, generally cylindrical and flexible for enabling the wand 24 to be easily moved and positioned to allow a user 28 to precisely dispense hot melt mix material 26 in a desired location on the ground or pavement. At one end 106 of the hose 22 shown in FIG. 4, the hose 22 has a threaded fitting 80 for being sealingly mated to a complementary threaded fitting (not shown) of the kettle 38. At its other end 108, the hose 22 has another threaded fitting 81 for being sealingly mated to a complementary threaded fitting 110 (FIG. 5) of the wand 24.

The hose 22 has a hollow conduit 82 defined by an inner wall 84 of generally circular cross section that is preferably constructed of braided stainless steel and through which hot melt mix material can flow after it has been heated to or above its flow temperature. Wrapped around the exterior of the interior hose wall 84 is a layer of silicone 86 that preferably is formed of a silicone tape. To maximize heat transfer from the heating element 30 to the hot melt mix material within the hose conduit 82, the heating element 30 is wrapped in a spiral or generally helical arrangement around both the silicone wrapping 86 and the inner wall 84 of the hose 22. To help electrically and otherwise insulate the heating element 30, there is another wrapping 88 of an insulating material that preferably also is silicone tape. To both thermally and electrically insulate the inner hose wall 84 and heating element 30, the second silicone wrapping 88 is preferably covered by a thicker layer of an insulating material 90 that preferably is, for example, an open or closed cell foam insulation. To provide a resilient and durable exterior, the layer of foam insulation 90 is covered by an outer layer of a flexible, resilient and durable material 92 that preferably is a rubber that is also capable of providing both electrical and thermal insulating properties. Advantageously, the construction and arrangement of the various layers which make up the hose 22 enable the hose 22 to transport hot melt mix material having a temperature of in excess of 300° F. without a user 28 being burned or receiving an electric shock.

The hose 22 is shown in more detail in FIGS. 10–14. Resistance to the pressure of fluid flowing within the conduit 82 is provided by a cylindrical layer 240 of braided or woven stainless steel which contacts and surrounds the conduit wall 84. The conduit wall 84 is constructed of or lined with tetrafluoroethylene (TEFLON), which comes into direct contact with the flowing hot melt mixture during applicator operation. A layer of silicone 86 surrounds and contacts the braided stainless steel layer 240. The novel heating element 30 is wrapped in a spiral around the silicone 86 and extends substantially the length of the hose 22. A layer of silicone tape 88 is wrapped around the heating element 30 to hold it in place. If desired, the foam rubber layer 90 can hold the heating element 30 against the silicone layer 86 without the use of tape.

Figure 10:
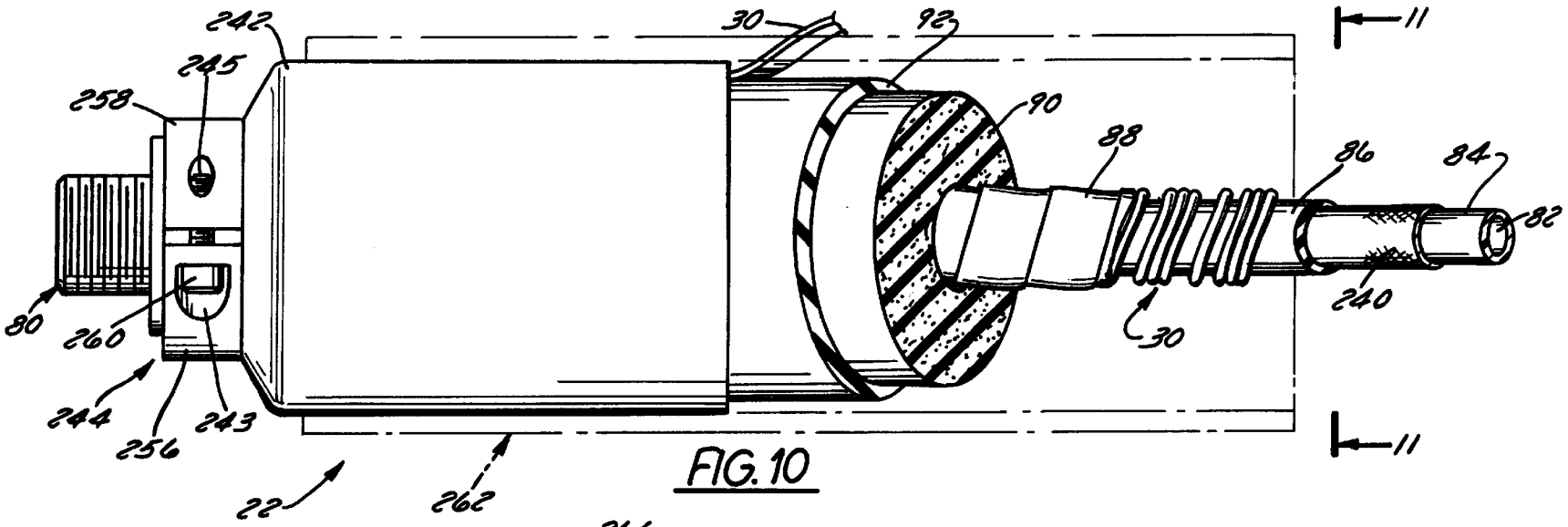
FIG. 10 is a fragmentary side view of a prior art hose construction cutaway to show the novel heating element wrapped interiorly around an inner conduit through which heated liquid flows.
Figure 12:
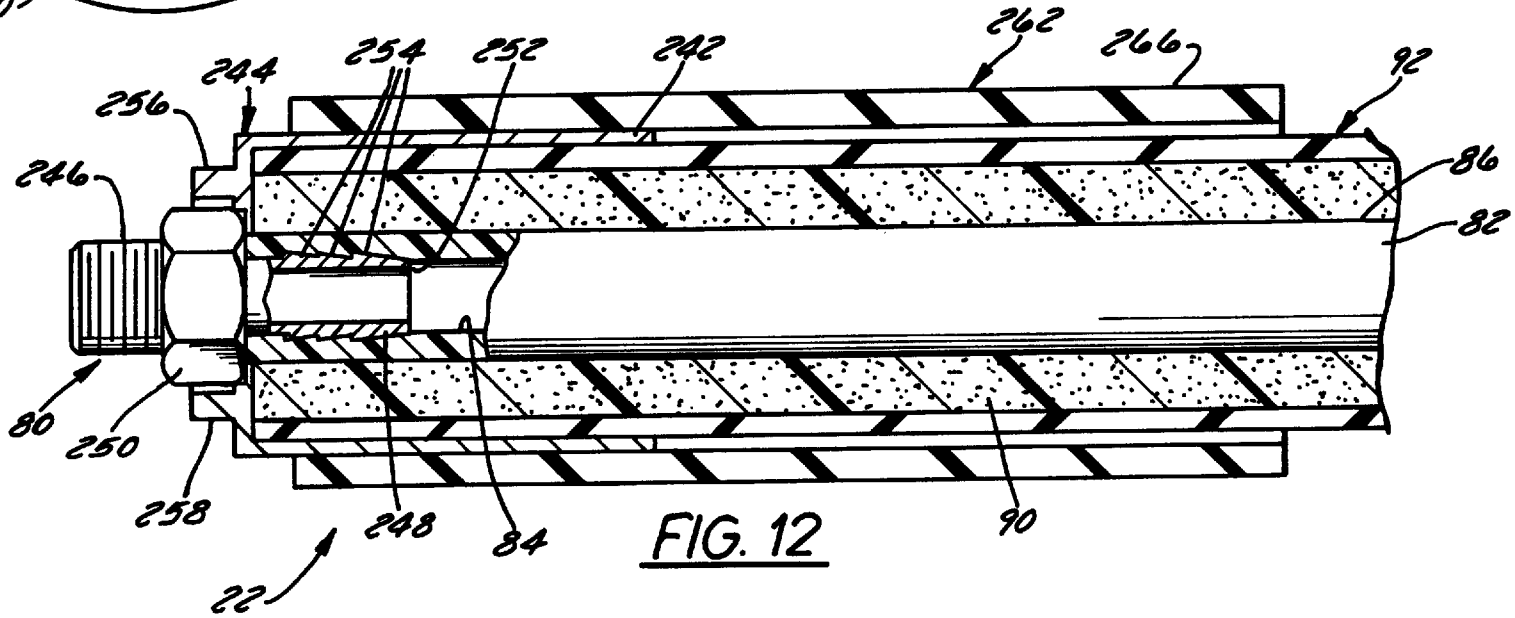
FIG. 12 is a longitudinal cross sectional view of the hose shown in FIG. 10.

Although only one end of the hose 22 is shown in FIGS. 10 & 12, both ends of the hose 22 are encased in a generally cylindrical metal collar 242 which fits around the protective outer rubber casing 92. The collar 242 is about 3.125 inches in axial length and has a clamp 244 which protrudes axially outwardly from the collar 242 that clamps around the fitting 80 at the end of the hose 22. The collar 242 is continuous, cylindrical, preferably made of steel, and has no bores or holes in it.

While the casing 92 is constructed of rubber, it lacks any internal reinforcing structure that would tend to resist twisting or crushing of the casing 92. Moreover, it is not tension bearing during operation because it is not immovably fixed to any other portion of the hose 22 and is not immovably affixed to the conduit 82 nor any fitting. It simply overlies and encases the foam rubber 90 surrounding conduit 82.

The heat element wiring 30, as well as wiring leading to a temperature sensor 122 (FIG. 4), enters the hose 22 between the collar 242 and the outer rubber casing 92. Although not shown in the drawing figures, the rubber casing 92 has a slit or opening adjacent the fitting 80, covered by the collar 242, permitting the wiring 30 to be inserted further radially inwardly into the hose 22 and wrapped around the silicone 86 that encases the conduit 82. Although not shown in the drawing figures, high temperature tape preferably is wrapped around the exterior of the rubber casing 92 underneath the collar 242.

Figure 14:
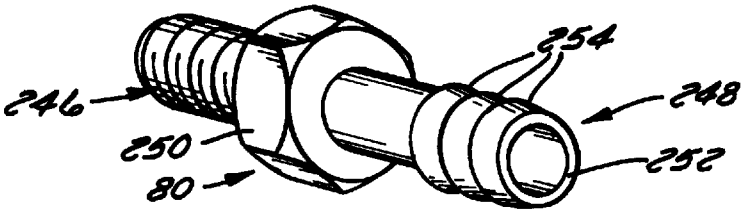
FIG. 14 is a perspective view of a threaded end fitting of the hose shown in FIG. 10.

Referring to FIG. 14, the fitting 80 is a transition pipe fitting 80 having a male threaded fitting 246 at the end which extends outwardly from the hose 22 for connection to a female fitting (not shown) of the wand 24 or kettle 38. At its other end, the transition fitting 80 has an insert fitting 248 constructed and arranged to be inserted into one end of the conduit 82. Typically, the female fitting (not shown) of the wand 24 or kettle 38 is part of a swivel that is located outside the hose 22 between fitting 80 and wand 24 and fitting 81 and kettle 38 enabling the hose 22 to rotate relative to the wand 24 and/or kettle 38 during operation. Between the threaded fitting 246 and insert fitting 248 is a square or hexagonal nut 250 that can be grasped by a wrench or another tool to help thread the threaded end 246 into a female fitting (not shown) or vice versa. The fitting 80 is typically made of steel, brass, copper or aluminum.

Referring additionally to FIG. 12, the insert fitting 248 preferably is a nipple 252 having spaced apart, generally coaxial, and radially outwardly extending shoulders or barbs 254, each of which engage the interior wall 84 of the conduit 82 when inserted into the conduit 82 to resist and preferably prevent withdrawal of the fitting 248 from the conduit 82. When inserted into the conduit 82, the insert fitting 254 is sized to provide a relatively tight friction fit between it and the conduit 82 to help resist its removal. To further resist its withdrawal, a metal band, strap or ferrule (not shown) is tightened or crimped tightly around the exterior of the wall 86 of the conduit 84 to urge the wall 86 into tight engagement with the fitting 248 and its barbs 254.

Figure 13:
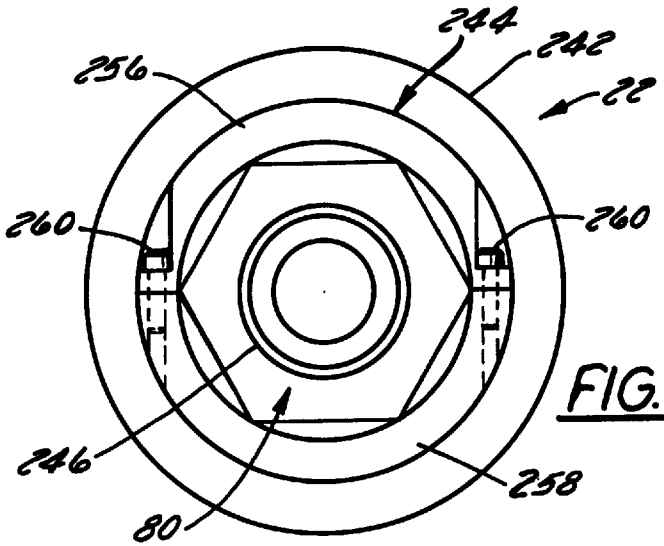
FIG. 13 is an end view of the hose shown in FIG. 10.

Referring to FIG. 13, the clamp 244 of the collar 242 is clamped around the hex nut 250 of the fitting 80 thereby immovably securing it to the fitting 80. The nut 250 of the fitting 80 is clamped between a pair of arcuate clamp plates 256 & 258 that relatively rigidly clamp the fitting 80 to the collar 242. Although not clearly shown in FIG. 13, one clamp plate 256 is completely separable from the collar 242 and, as shown more clearly in FIG. 10, has a pair of spaced apart through-bores 243. The bores 243 are coaxial with threaded bores 245 in the other clamp plate 258. Clamp plate 258 is welded to the collar 242 to rigidly attach it to the collar 242.

With the fitting 80 received between the clamp plates 256 & 258 such that the threaded end 246 extends outwardly from the end of the collar 242, a cap screw or bolt 260 inserted through each bore 243 in the separable clamp plate 256 is threaded into a coaxial threaded bore 245 in the collar clamp plate 258. With the bolts 260 inserted and tightened, the plates 256 & 258 clamp tightly against corners of the hex nut 250 of the fitting 80, rigidly securing the collar 242 to the fitting 80.

Referring to FIG. 12, while the collar 242 fits around the hard rubber casing 92 it does not tightly friction fit around the casing 92 and is assembled to the fitting 80 such that when the bolts 260 are removed, the collar 242 can be slipped off of the casing 92 relatively easily and with relatively little effort. The collar 242 functions only to minimize flexing of the hose 22 adjacent the fitting 80 during operation. As a result, the collar 242 does not immovably fix the casing 92 to any fitting of the hose 22 and certainly not fitting 80.

Figure 11:
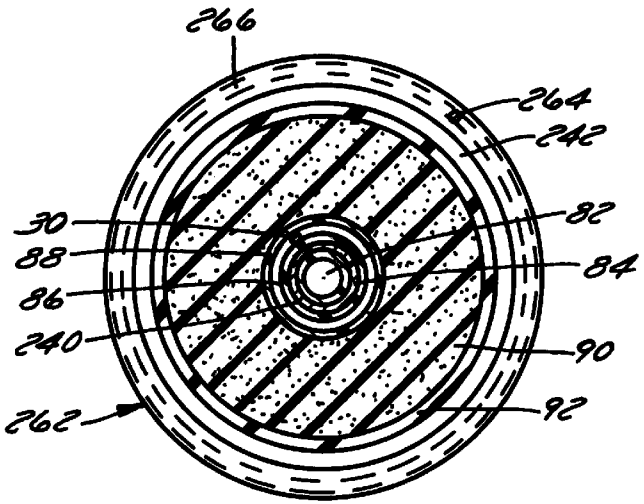
FIG. 11 is a transverse cross sectional view of the hose taken along line 10—10 of FIG. 10.

To further prevent flexing and bending of the hose 22 adjacent the fitting 80, about a one foot section of two inch diameter cylindrical marine exhaust hose 262 is relatively tightly friction fit over the collar 242 or affixed to the collar 242, as is shown in FIGS. 10–12. The marine exhaust hose section 262 is constructed of a thermoset material, typically rubber, that has a helical metal reinforcing wire 264 (FIG. 11) within its sidewall 266. The marine exhaust hose section 262 does not extend the full length of the hose 22.

While the hose construction 22 depicted in FIGS. 10–14 has enjoyed substantial commercial success, improvements nonetheless remain desirable. For example, when the hose 22 is pulled, tension is transmitted the length of the hose 22 from one fitting 80 or 81 through the conduit 82 and the braided wall 240 surrounding the conduit 82 to the other fitting 81 or 80. Because the collar 242 does not tightly urge the outer rubber casing 92 and foam rubber layer 90 against fitting 80, very little tension, if any, is transmitted through the foam rubber layer 90 and casing 92. As a result of pulling tension being transmitted only through the braided layer 240 and conduit 82, repeated pulling of the hose 22, as typically happens during operation, can cause the conduit 82 to pull completely free of fitting 80 or 81 resulting in failure of the hose 22.

Even assuming that the collar 242 could be tightly clamped or fitted around the casing 92, it still would not enable the casing 92 and/or foam rubber layer 90 to transmit a great deal of tension the length of the hose 22 because the foam rubber layer 90 is porous, highly compressible, possesses little strength in tension and extends the length of the casing 92. As a result of its porous construction, the foam rubber layer 90 compresses under the force of the collar 242 making it difficult, if not virtually impossible, for the collar 242 to tightly engage the casing 92 and immovably fix the casing 92 to any fitting 80 or 81.

Another problem with this hose construction 22 is that bending of the hose 22 anywhere between the marine exhaust hose sections 262 of both fittings 80 & 81 can cause the conduit 82 to kink undesirably reducing or even completely stopping hot melt mix flow through the conduit 82. Even worse, repeated kinking in the same area of conduit 82 can weaken the conduit 82 making it even more susceptible to repeated kinking until it cracks and fails.

A still further problem is that the hose 22 can be twisted during use which can also twist, weaken and kink the conduit 82. Repeated twisting of the conduit 82 can ultimately tear the conduit 82 causing it to fail.

A still another problem is that the outer casing 92 is constructed of a homogenous rubber sidewall only about 0.125 inches thick and lacks any reinforcing structure within the casing sidewall thereby making the hose relatively susceptible to crushing should a heavy load be applied to the hose 22, such as what can happen should a pavement roller or pavement compactor run over the hose 22. If large enough, the load can not only crush the outer casing 92, it can also crush the conduit 82 such that flow of hot melt mix through the conduit 82 is impeded or completely obstructed resulting in failure.

Unfortunately, failure of the hose 22 typically requires its replacement because it is no longer suitable for transporting hot melt mix. Where the failed hose 22 is relatively new, replacement is done under warranty undesirably significantly increasing warranty costs. Even when a failed hose 22 can be repaired, it still is costly because hose repair is a labor intensive process.

2. Novel Hose Construction

FIGS. 15–18 illustrate a novel hose construction 22' of this invention for transporting heated flowable materials, such as preferably a hot melt mix material that consists of, at least in part, petroleum-based material or materials, including without limitation heated flowable tar, bitumen, asphalt or another suitable flowable material that is heated to make it flow and applied while hot on an object as part of a processing operation or a repair operation. While the hose construction of this invention can be used to apply conventional hot melt mix, it can also be used to apply hot glue, hot polymer, hot elastomeric material, hot thermoplastic material and hot thermosettable material which becomes flowable when heated and which must be heated to a fluid-like state before being applied to an object as part of a processing or repair operation. While the hose 22' of this invention is well suited for transporting heated flowable mixtures, it is also well suited for transporting a heated flowable material that is composed of only a single component, a single material, a single chemical, a single chemical compound or another heatable flowable material which is not a mixture of materials.

As is depicted in FIGS. 15–18, the novel hose 22' has an elongate inner flexible reinforcing tubing 270 through which the heated flowable material flows that is constructed and arranged to be flexible, so the hose 22' can bend during use, while limiting the bending of fluid-tight conduit 82 to a radius of curvature of no smaller than about one inch for preventing kinks from forming in the conduit 82 and tubing 270. Preferably, the flexible tubing 270 is constructed such that it cannot be bent over itself such that one portion of the tubing 270 is folded over on another portion of the tubing 270 at the point where the tubing 270 is bent for preventing kinking.

Figure 15:
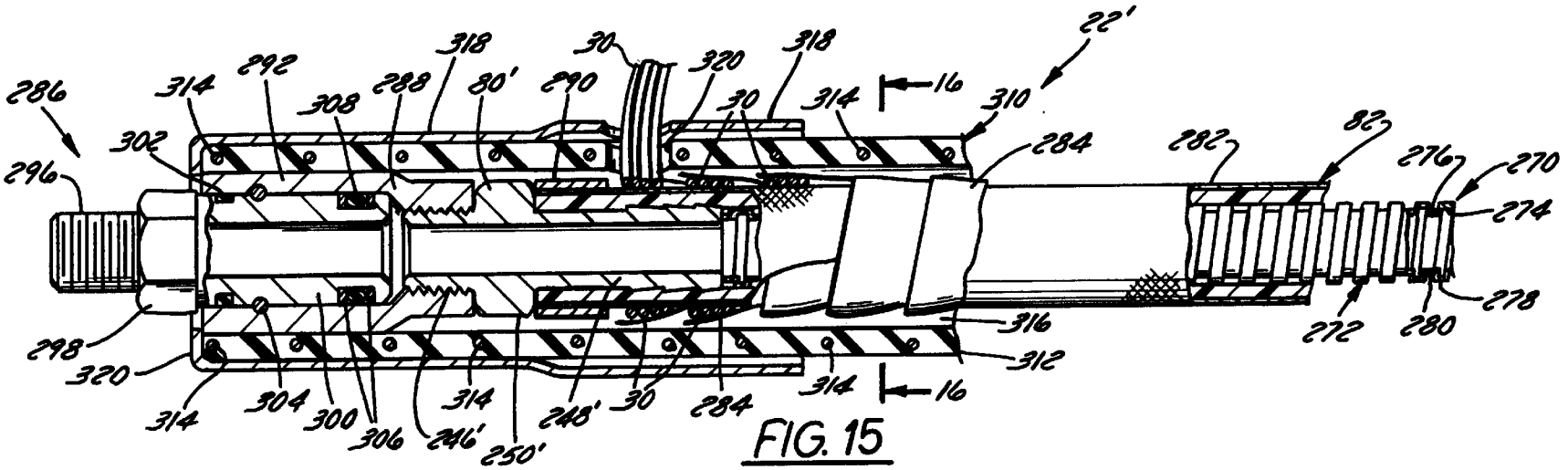
FIG. 15 is a cross sectional side view of a novel heated hose construction.

As is shown in FIG. 15, the flexible reinforcing tubing 270 preferably is helical interlocked flexible aluminum conduit of conventional construction that can also be made of steel, copper or another material impervious to the heated flowable material flowing through it during operation. Preferably, the tubing 270 is constructed of aluminum so it is strong, crush resistant, corrosion resistant, kink resistant, yet light in weight.

The tubing 270 preferably is formed of a single continuous elongate strip 272 of relatively thin but generally rigid material having a flange 274 extending outwardly in one direction along one edge of the strip 272 and another flange 276 extending outwardly in an opposite direction along the other edge which interlock when the strip 276 is helically coiled and flange 274 engaged with an adjacent flange 276 of an adjacent portion of the strip 272 to form a generally cylindrical tube 270 that is flexible and axially compressible while providing excellent crush resistance. To limit axial compression of the tubing 270 while further increasing its crush resistance, the strip 272 has a generally U-shaped radially outwardly extending ridge 278 between the flanges 274 & 276 and a flat portion 280 alongside the ridge 278. The width of the flat 280, along with the interlocking flange construction of the tubing 270, helps control the amount that the tube 270 can bend while also limiting how much it can be axially compressed and expanded.

Preferably, the aluminum flexible tubing 270 has an outer diameter of between about 0.495 and about 0.490 inches so as to allow hot melt mix to flow relatively unimpeded through it. Preferably, the tubing 270 has a ridge height of between about 0.0625 inches and about 0.03125 inches and a wall thickness of approximately one millimeter. The tubing 270 is received within conduit 82 and can move axially relative to conduit 82 during operation. Although each end of the tubing 270 can be fixed adjacent each end of conduit 82 by being friction fit, captured between conduit 82 and fitting 80, or attached in another manner such that each tubing end does not move relative to the conduit 82 at or adjacent its end, it preferably is not fixed at each end.

During assembly, because the tubing 270 is axially compressible, a length of tubing longer than the axial length of the conduit 82 is slidably telescopically inserted into the conduit 82 such that it floats within the conduit 82. For example, where the desired length of the hose 22' (and conduit 82) is fourteen or fifteen feet, as much as twenty-two feet of tubing 270 is stuffed into the conduit 82. Where the conduit 82 is ten foot long, approximately thirteen and one-half feet of tubing 270 is stuffed into the conduit 82. By axially compressing the tubing 270, it helps prevent kinking by limiting the radius of curvature of any bend of the tubing 270.

Conduit 82 is preferably constructed of or lined with tetrafluorethylene (TEFLON) or another suitable polymeric material, but can be constructed of another flexible and resilient synthetic, plastic or elastomeric material such as nylon, polyurethane, polyethylene, a plastic or another material that is relatively impervious to the heated flowable material flowing through flexible tubing 270. Preferably, conduit 82 is impervious to petroleum products, tar, bitumen and asphalt. TEFLON is the preferred material of construction of conduit 82 because it is flexible, is relatively impervious to commercially available hot melt mixes, offers relatively low resistance to fluid flow, and is resistant to temperatures above 350° Fahrenheit, making it particularly well suited for conducting flowable hot melt mix having at similar high temperatures. In one exemplary preferred embodiment, conduit 82 has an inner diameter of about 0.75 inches so as to receive tubing 270 such that there is a sliding or loose fit therebetween and has a wall thickness of slightly greater than about 0.03125 inches. Between the ends of the tubing 270 and conduit 82, the sliding or loose fit permits the tubing 270 to move relative to the conduit 82 during bending to facilitate bending of both the tubing 270 and conduit 82 substantially in unison.

Preferably, the conduit 82 has an outer sheath or sleeve 282 comprising of a woven or braided material that is constructed and arranged to improve the pressure resistance of conduit 82 to fluid or flowable material flowing through the tube 270 and/or conduit 82. Although the sleeve 282 can be constructed of steel or an alloy thereof, such as a woven or braided stainless steel, it preferably is constructed of woven or braided nylon or another suitable synthetic material resistant to high temperature while also being burst resistant. By this construction, sleeve 282 imparts increased burst resistance to conduit 82.

Where the hose 22' is designed to be heated during operation, heating element wires 30 are preferably wrapped directly around sleeve 282. To hold the wiring 30 against the sleeve 282, there is a constraining layer 284 over the wiring 30 that preferably comprises silicone tape 284. If desired, however, the heat element wires 30 can be wrapped around a layer of silicone or similar material that encases the sleeve 282. While the hose 22' of this invention is well suited for use with the novel three phase heating element system disclosed herein, it also can be used with a single phase heating element or another type of hose heater.

Referring now to the ends of the hose 22', a representative end 286 of the hose 22' is shown in FIG. 15. The hose end 286 shown in FIG. 15 is substantially the same as its opposite end (not shown) except that the opposite hose end can be constructed without heat element wiring 30 entering or exiting the hose 22'. As is depicted in FIG. 15, recessed within each end of the hose 22' is a fitting assembly 287 comprising a transition fitting 80 and a swivel fitting 288.

Figure 17:
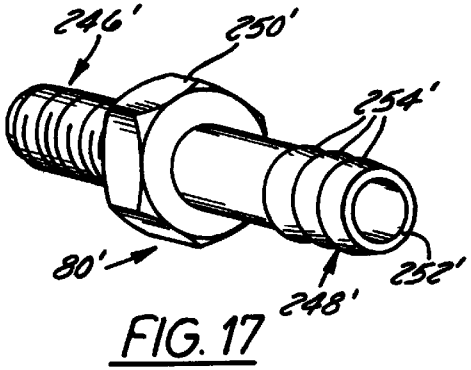
FIG. 17 is a perspective view of a hose fitting of the hose shown in FIG. 15.
Figure 16:
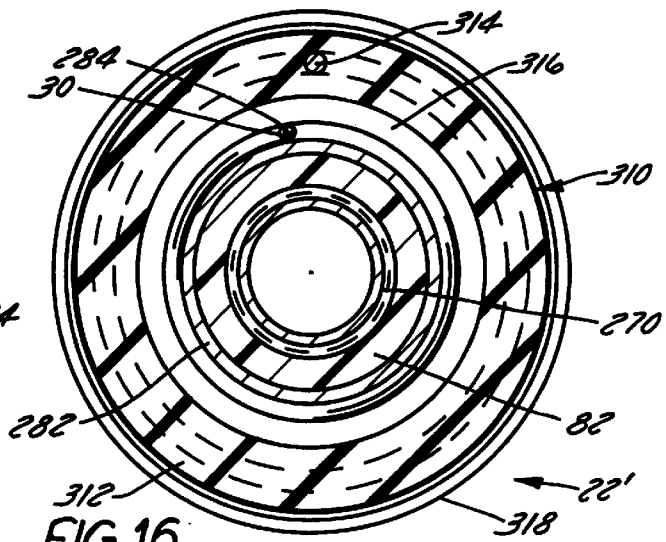
FIG. 16 is cross sectional view of the hose taken along line 16—16 of FIG. 15.

As is shown in FIG. 17, fitting 80' is substantially the same as fitting 80 depicted in FIG. 14. Preferably, it is virtually identical and hence will not be described further herein. Fitting 80' is further axially recessed within the hose 22' than it is in hose 22 to accommodate a swivel fitting 288 within the hose 22'. By recessing the swivel 288, it helps insulate the swivel 288 thereby lessening heat loss from hot mix material flowing through the swivel 288. By lessening heat loss, less energy is required to maintain the temperature of the hot melt mix flowing through the hose 22' thereby also helping to maximize the rate of flow of hot melt mix material through the hose 22'.

Referring once again to FIG. 15, fitting 80' has its barbed end 248' fluidtightly received in the end of conduit 82 with the axially outer end of the barbed end 248' preferably adjacent or abutting an end of the flexible tubing 270. To help keep the conduit 82 on the fitting 80', there is a metal ferrule 290 clamped or crimped around the conduit 82 urging the conduit 82 into tight intimate contact with a portion of the fitting end 248'.

Figure 18:
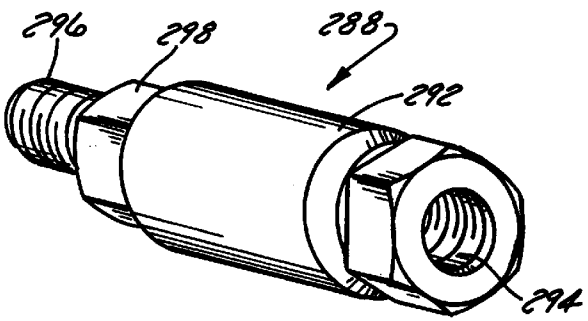
FIG. 18 is a perspective view of a swivel fitting of the hose shown in FIG. 15.

Referring additionally to FIG. 18, the swivel 288 is constructed to permit the hose 22' to rotate at each end relative to either the wand 24 or kettle 38 or a fitting of the wand 24 or kettle 38. By permitting the hose 22' to rotate, twisting of the hose 22' is minimized, further helping to prevent conduit 82, as well as tubing 270, from kinking and tearing.

The swivel 288 has an outer housing 292 with a female threaded fitting 294 at one end that threads on the male threaded end 246' of fitting 80'. Extending outwardly from inside the swivel housing 292 is an exteriorly threaded male fitting 296, constructed and arranged to rotate relative to the housing 292, that preferably threads into a female fitting of either the wand 24 or kettle 38. The male swivel fitting 296 has a square or hexagonal nut 298 located adjacent the housing 292 which is located outside the hose 22' so it can be engaged by a wrench or another tool to rotate it to thread it into or unthread it from the female fitting of the wand 24 or kettle 38.

To provide a fluid tight seal between a portion 300 of the threaded swivel fitting 296 received inside the swivel housing 292 and the housing 292, the fitting 296 has a grease or dust seal 302 between it and the housing 292 that preferably comprises an O-ring 302 constructed of BUNA-N or a similarly suitable seal material. To facilitate rotation of the fitting 296 relative to the housing 292, there are a plurality of circumferentially spaced apart ball bearings 304 between the fitting 296 and housing 292 which are preferably constructed of chromium or another suitable bearing material. To further provide a seal, the swivel 288 has a pair of axially spaced apart O-rings 306 preferably constructed of HYTREL or the like that sandwich another O-ring 308 constructed of a suitable seal material that preferably is AFLAS or VITON.

To prevent the fitting 296 from separating from the housing 292 while permitting it to rotate relative to the housing 292, the housing 292 can be and preferably is constructed with a radially inwardly extending set screw or bolt (not shown) that is seated in a complementary groove (not shown) in the outer surface of the inner fitting portion 300 which extends about the circumference of the fitting portion 300. Preferably, both the housing 292 and threaded fitting 296 of the swivel 286 are constructed of steel that is zinc plated such that it is suitable for hydraulic oil applications making it well suited for hot melt mix materials.

To transfer tension during pulling of the hose 22' away from the inner conduit 82, the hose 22' has a hollow and generally cylindrical outer protective casing 310 that extends from one end of the hose 22' to the opposite end of the hose 22' and which is immovably fixed at each end of the hose 22' to the fitting assembly 287 by being secured to either the swivel housing 292 or the nut 250' of fitting 80', or both.

Preferably, the casing 310 is constructed of a durable, resilient and at least somewhat flexible material that preferably is resistant to relatively high temperatures in excess of about 300° Fahrenheit. Preferably, the casing 310 comprises a single continuous generally cylindrical sidewall 312 composed of a thermoset material that is durable such that it can withstand scraping along pavement as well as being resistant to abrasions, cuts and nicks which can occur during use. Preferably, the casing 310 is constructed and arranged such that it limits bending of the conduit 82 by itself not being able to be bent no less than about a 1.5 inch radius of curvature.

Preferably, the casing sidewall 312 is composed of a rubber, such as PVC rubber (a mixture of acrylonitrile-butadiene rubber and polyvinylchloride) or the like and can be laminated with a relatively thin sheet of helically woven fabric about its outer surface. If greater temperature resistance is desired, the casing sidewall can be constructed of neoprene rubber. A casing 310 of this construction is relatively stiff yet flexible to allow the hose 22' to bend a limited amount while preventing the radius of curvature of the hose bend from becoming too small to prevent kinking of conduit 82.

To resist extreme bending and crushing of the casing 310, the casing 310 preferably is reinforced with a continuous and generally helical wire 314 embedded within the casing sidewall 312. Preferably, the wire 314 is constructed of spring steel, stainless steel, or another stiff material to help the casing 310 resist bending and crushing of the casing 310 thereby protecting the conduit 82 and tubing 270 from being crushed.

As is shown in FIG. 15, the casing 310 encompasses both fitting 80' and swivel fitting 288 helping to insulate them. Preferably, the inner diameter of the casing 310 is larger than the outer diameter of the conduit 82, even with the heating element 30 wrapped around it, so that there is an insulating annular air gap 316 between the exterior of the silicone tape 284 and the interior of the casing 310. If desired, an insulating foam or another insulating material can be provided in the gap 316.

In the exemplary preferred embodiment, the casing 310 is a bellowsflex type hose having an inner diameter of about 1.25 inches and a wall 312 having a thickness of about 0.1875 inches with an embedded integral helical or spiral reinforcing wire 314 having adjacent loops of the wire 314 axially spaced apart a little more than about 0.38 inches. For example, a suitable casing 310 can be a hose constructed in accordance with SAE standard J 1527 and which also complies with U.S. Coast Guard Type B-2 marine hose requirements. Preferably, the casing 310 is a marine fuel or exhaust hose having the aforementioned dimensions and complying with the above mentioned standards and/or ratings. Preferably, the casing 310 is a bellowsflex-type marine fuel or exhaust hose. If desired, the casing 310' can also comprise a conventional steel helix reinforced rubber gasoline hose or a bellowsflex-type rubber gasoline hose of similar construction.

Advantageously, a casing 310 of this construction is fluidtight, tough, durable, resilient, flexible, kink resistant, crush resistant, relatively impervious to most chemicals, and twist resistant to preventing kinking and tearing of the conduit 82 within while also transmitting hose tension away from conduit 82 helping to prevent conduit 82 from pulling free of fitting 248'.

The protective outer casing 310 is immovably fixed at each end to the swivel housing 292. While the casing 310 can be adhesively affixed to the swivel housing 292 or secured to the housing 292 using one or more fasteners (not shown), the casing 310 preferably is fluidtightly fixed to the housing 292 by an outer metal collar 318 that urges the casing 310 against housing 292. Preferably, the collar 318 is crimped around the casing 310 and housing 292 adjacent the swivel fitting 296 urging the casing 310 into tight intimate contact with the swivel housing 292. By this tightly crimped construction, none of fittings 80' & 288 will pull free of the casing 310 during operation resulting in pulling forces (hose tension) being transmitted primarily along the casing 310 to the fitting 288 and vice versa thereby minimizing the amount of force transmitted to and through conduit 82.

If desired, one end of the collar 318 can be crimped downwardly such that it forms a lip 320 around the end of the casing 310. If desired, the lip 320 can extend radially inwardly beyond the axial end of the swivel housing 292 such that it interferes with the end of the housing 292 to oppose withdrawal of the housing 292 from the casing 310.

The collar 318 preferably is constructed of a metal that preferably is steel. However, if desired, the collar 318 can be constructed of copper, brass, aluminum or another suitable metal or non-metallic material. For example, the collar 318 can be constructed of a heat shrinkable material that is tightly heat shrunk around the casing 310 and swivel housing 292.

To permit the heat element and temperature sensor wiring to be introduced around the inner conduit 82, the casing 310 has a hole 320 in it through which the wiring extends. To prevent flexing of the casing 310 from tearing the casing 310 at or about the hole 320, the collar 318 axially extends beyond and around the hole 320, as is shown in FIG. 15, to limit the amount of movement and flexing the casing 310 can undergo near the hole 320, in effect providing strain relief to the casing 310. To accommodate the wiring 30, the collar 318 itself has a through bore 322 through which the wiring 30 also passes.

In assembly, the conduit 82 is cut to size and the fitting 80' is inserted into the conduit 82. Thereafter, the flexible tubing 270 is inserted into conduit 82 preferably until its axial end abuts or is adjacent the end of the insert fitting 248' of fitting 80'. Thereafter, fitting 81 is attached to the other end of the conduit 82 capturing the tubing 270 within. The swivel fitting 288 is attached to the threaded end 246' of fitting 80' and the conduit 82 is inserted into casing 310. Before the conduit 82 is inserted into the casing 310, it is wrapped with heating element wiring 30. Each end of the casing 310 is fixed to the swivel housing 292 by the collar 318 resulting in a high temperature hose 22' that is ready to be used.

After the hose 22' is assembled, it is attached at one end preferably to a generally stationary object, such as the kettle 38, and at its other end to an object that can be and typically is maneuvered during operation, such as the wand 24. If desired, two or more hoses 22' can be coupled to make a longer length of hose.

In operation, heated flowable hot melt mix material flows through the interior of the flexible tubing 270 from one end of the hose 22' to the other end of the hose 22'. As the hose 22' is twisted, one or both swivels 288 at each end of the hose 22' permit the hose 22' to rotate relative to either or both the wand 24 and/or kettle 38 thereby preventing the hose 22' itself from twisting too much thereby preventing kinking and collapse of conduit 82. The casing 310 also inherently resists twisting of the hose 22' and conduit 82.

As the hose 22' is bent, the casing 310 increasingly resists bending for helping to prevent the hose 22' from reaching such a small radius of curvature that the conduit 82 kinks. In addition to the casing 310 resisting bending, the flexible tubing 270 within the conduit 82 further resists bending in this same manner.

As the hose 22' is externally compressed radially inwardly by an external crushing force, the wire reinforced construction of the casing 310 resists crushing of the casing 310 thereby also protecting the conduit 82 and tubing 270 within. Should the casing 310 be crushed such that it contacts the conduit 82, the tubing 270 provides further crush resistance to the conduit 82.

As the hose 22' is pulled, most, if not virtually all of the hose tension, and hence strain, is transmitted from one end of the hose 22' along the casing 310 to the other end of the hose 22' by virtue of the casing 310 being rigidly fixed to swivel housings 292 at both ends and the swivel housings 292 being rigidly connected to the kettle 38 and wand 24. Preferably, tension actually applied to the conduit 82 during stretching of the hose 22' is advantageously minimized by this novel hose construction because most, if not virtually all, of the tension is transferred around the conduit 82 to end fittings 288 thereby preventing any end of the conduit 82 from ever being pulled free of fitting 82.

3. Novel Heating Element

To prevent hot melt mix inside the hose 22 from solidifying in the hose 22 during operation, coaxially wrapped in a spiral or helical arrangement around the inner wall 84 of the hose 22 is the heating element 30. The heating element 30 is comprised of a cord 94 having three wires 96, each of which carries current during operation to generate heat to heat the hot melt mix material within the hose conduit 82.

The three wire heating element 30 is a three phase heating element for carrying three phase current to more efficiently heat the hot melt mix within the hose 22. As is shown in FIGS. 4 and 4B, the heating element cord 94 has a first wire 98 for carrying one phase of the three phase heating current, a second wire 100 for carrying another phase of the three phase heating current, and a third wire 102 for carrying a further phase of the three phase heating current.

As is shown in FIG. 4B, to prevent electricity from passing between the wires 98, 100 and 102 during operation, the exterior cord material is constructed of an electrically insulating material 132 that preferably also spaces each wire apart from the other wires to further prevent short circuiting. The cord 94 preferably is of generally elongate and oblong cross section having a top surface 134, a bottom surface 136 and a pair of sides 138 constructed and arranged such that its width is at least slightly larger than its thickness. To maximize heat transfer from the wires 98, 100 and 102 to the hose 22 and hot melt mix material flowing through the hose 22, the cord 94 is wrapped around the hose 22 such that one of its elongate surfaces, 134 or 136, are in contact with the hose 22. Preferably, the cord 94 is wrapped around the hose 22 such that its generally flat bottom surface 136 is in contact with the silicone layer 86 overlying the inner hose wall 84 and bears against the inner hose wall 84. In this manner, heat generated by all three wires 98, 100 and 102 is efficiently transmitted through the silicone 86, inner hose wall 84 and to the hot melt mix material flowing through the hose 22 to help keep the material in a flowable state.

To provide the desired heat flux along the length of the hose 22 to prevent solidification, the distance, a, between adjacent loops or coils of the cord 94 is about three quarters of an inch. Alternatively, the cord 94 can be wrapped about the hose 22 such that the distance between adjacent loops or coils, a, is between about one-half inch and about one inch. In a preferred embodiment, the heating element cord 94, the wires 98, 100 and 102, the spacing, a, between adjacent loops of the cord 94, and the three phase current applied to the cord 94 are selected to provide a heat flux of about 3.5 watts per inch$^2$.

Each wire 98, 100 and 102 of the cord 94 is constructed of an electrically conductive material that has sufficient resistance to electrical current flow such that it generates heat upon the passage of current through the heating element wire. Preferably, each wire 98, 100 and 102 is constructed of a resistive copper material, nichrome, an iron-nichrome-aluminum alloy, or another electrically resistive, electrically conductive material that produces heat upon the application of electrical current. Preferably, each wire 98, 100 and 102 is constructed of teflon coated copper and can have a wire diameter of about eighteen gauge.

Advantageously, the construction and arrangement of the heating element 30 is such that each wire 98, 100 and 102 of the heating element cord 94 wrapped around the hose 22 generates heat when three phase current is applied to the heating element 30. Advantageously, no neutral or return wire is required, so all of the wires 98, 100 and 100 of the heating element 30 generate heat to more efficiently heat the hot melt mix material inside the hose 22 and wand 24. As a result, the surface area of heat generation is maximized per unit length of heating element cord 94 as compared to a single phase heating element cord.

Figure 5:
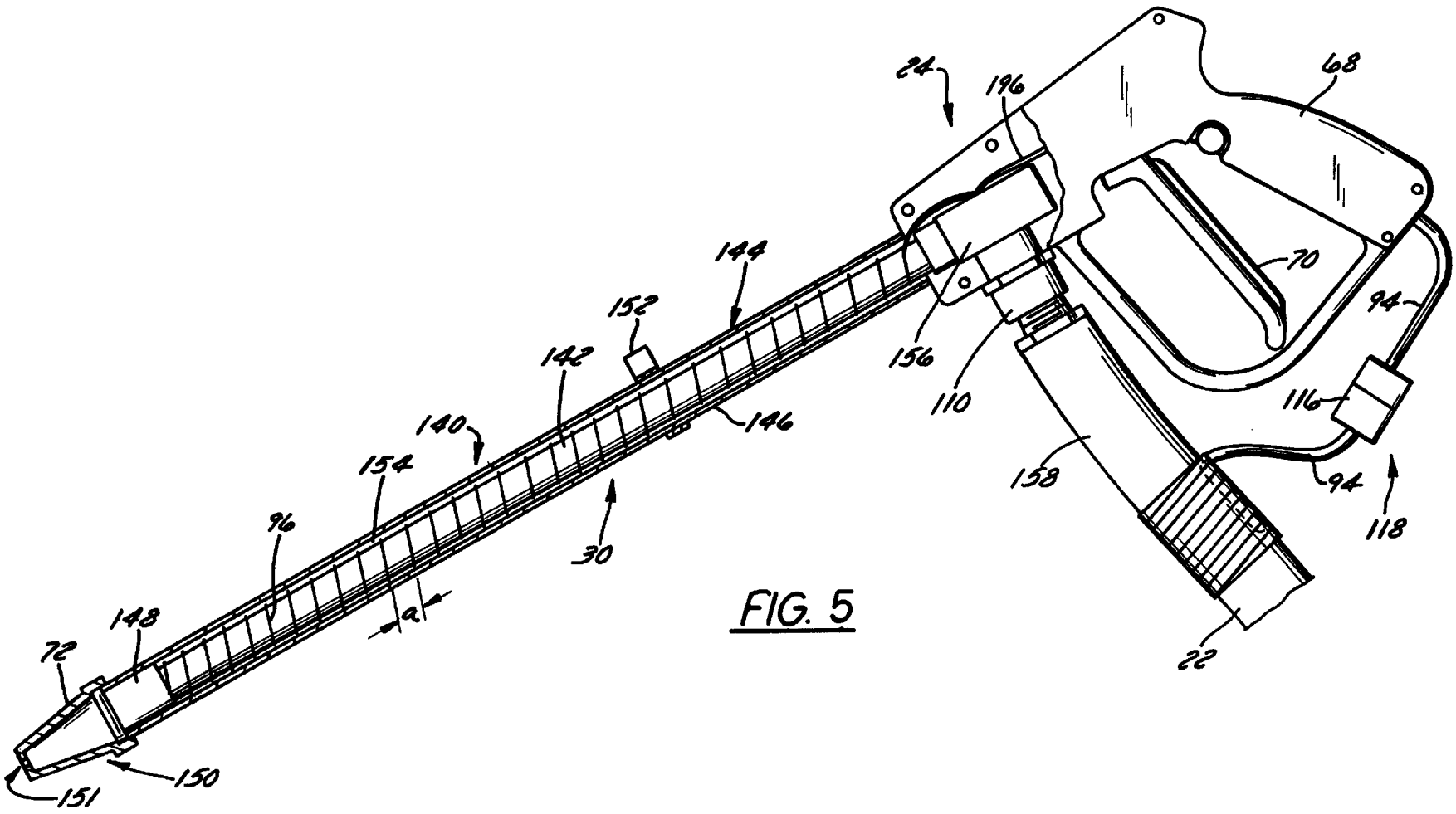
FIG. 5 is a side view of a wand of the applicator partially broken away to show its three phase heating element.

At the kettle end 106 of the hose 22, the input end 112 of the heating element cord 94 is preferably in electrical communication with a three phase electrical power source 114 (FIG. 1) for receiving three phase electrical power from the power source 114. Referring additionally to FIG. 5, at the wand end 108 of the hose 22, preferably the cord 94 is attached by a connector 116 to the heating element 30 of the wand 24. Since heating is not necessary where the cord 94 is exposed between the wand 24 and hose 22, the cord 94 preferably has a non-heating portion 118 between the wand 24 and hose 22 that preferably is constructed of a larger diameter copper wire that can be of fourteen gauge or thicker copper wire.

Alternatively, the heating element cord 94 can be constructed and arranged to terminate at or adjacent the wand end 108 of the hose 22, such as at reference numeral 120 (FIG. 4), if it is only necessary to heat the hose 22 and not the wand 24 during operation. If the heating element cord 94 terminates at the wand end 108, each of the three wires 98, 100, and 102 are connected together, preferably at reference numeral 120, to form a complete three phase heating element circuit.

To enable sensing of the temperature of the hot melt mix material within the hose 22, the hose 22 preferably also has a temperature sensor 122. As is shown in FIG. 4, the temperature sensor 122 is received in a hollow in the foam insulating layer 90 and is secured to the hose 22 by at least one layer of a tape 124 that preferably is silicone tape. Preferably, the sensor 122 is affixed to the hose 22 such that it bears against the inner hose wall 84 for being able to more accurately sense the temperature of the hose 22 and hot melt mix material in the hose 22 in the region of the sensor 122.

Preferably, the temperature sensor 122 is an RT-type thermocouple 126 for providing an electrical current representative of the temperature of the hot melt mix material inside the hose 22. To communicate current from the sensor 122 to a device, such as preferably the controller 128 (FIGS. 1, 6 and 8), the sensor 122 has a pair of wires 130 extending from it. Preferably, the sensor 122 is disposed at least about six inches from the axial end of the fixture 80 at the kettle end 106 of the hose 22 for facilitating accurate temperature measurement. Alternatively, the sensor 122 can be a thermistor or another type of sensor capable of sensing the temperature of hot melt mix inside the hose 22.

Alternatively, if desired, the temperature sensor 122 can be affixed to the wand 24 for measuring the hot melt mix material temperature at a point remote from the kettle 38. Alternatively, a pair of sensors (not shown) can be used with, for example, one of the sensors in communication with the hose 22 and the other of the sensors in communication with the wand 24. However, the preferred embodiment of this invention requires only a single sensor 122 carried by the hose 22 capable of sensing or representing the temperature of the hot melt mix material within the hose 22 and adjacent the sensor 122.

Advantageously, as a result of the construction and arrangement of the three phase heating element 30, construction of the hose 22 and the use of three phase electrical current to heat the hot melt mix, only one temperature sensor 122 is needed. Alternatively, more than one temperature sensor can be used, if desired, to provide the temperature of hot melt mix at different locations along the hose 22. Alternatively, more than one temperature sensor can be used, if desired, to provide the temperature of hot melt mix material in the wand 24 or at different locations along the wand 24.

B. Wand Construction

The wand 24 has a dispenser gun 68 with a generally cylindrical and elongate hollow barrel 140 extending outwardly from the gun 68 for enabling hot melt mix material to be dispensed from the wand 24 conveniently onto the ground without an operator 28 having to uncomfortably bend down or stoop during operation. The barrel 140 of the wand 24 is preferably constructed of a rigid, generally cylindrical and elongate pipe or tube 142 that can be constructed of a metal, such as a stainless steel; a plastic, such as a thermoset; a composite, such as a glass filled nylon; a ceramic; a combination thereof, or another suitable material. The tube 142 is hollow for permitting passage of hot melt mix material through the tube 142. The tube 142 is preferably threadably received in a complementary threaded female fitting of the dispenser gun 68.

Generally coaxially overlying the hot melt mix flow tube 142 is an outer covering 144 that preferably also is generally tubular and elongate. The outer covering 144 is spaced sufficiently radially outwardly away from the hot melt mix flow tube 142 such that it insulates a user 28 of the wand 24 from the heat of the hot melt mix flowing through the tube 142. Preferably, the covering 144 is a support tube 146 that is attached to the dispenser gun 68 at one end and a dispenser cap 148 at the other end. To help manipulate the rather long wand 24 during operation, a user 28 can grasp a handle 152 attached to the support tube 146 at a location disposed downstream from the dispenser gun 68.

The duckbill valve 72 is carried by the cap 148 at the nozzle 151 at the free end 150 of the wand 24. The cap 148 is also attached to the free end of the hot melt mix tube 142 and has an outer diameter larger than the outer diameter of the hot melt mix tube 142 for radially outwardly and coaxially spacing the support tube 146 from the hot melt mix tube 142. If desired, an envelope 154 between the hot melt mix flow tube 142 and the support tube 146 can contain an insulation, such as an open or closed cell foam.

As is shown in FIG. 5, the hot melt mix applicator wand 24 also has a heating element 30 that preferably extends to adjacent the free end 150 of the wand 24 for providing heat to hot melt mix material in the flow tube 142 of the wand 24. To complete the three phase electrical heating circuit, the wires 98, 100 and 102 of the heating element cord 94 are electrically connected together preferably in or adjacent the end cap 148.

As is shown in FIG. 5, a preferably non-heating portion 118 of the heating element cord 94 of the hose 22 emerges from a collar 158 adjacent the end 108 of the hose 22 and connects to another preferably non-heating element portion 118 of the heating element cord 94 of the wand 24. Where hot melt mix material leaving the hose 22 enters the dispenser gun 68, it is preferably redirected through a generally perpendicular elbow 156 in the gun 68 into the flow tube 142. To prevent solidification of hot melt mix material in the region of the elbow 156, at least a portion of the heating element cord 94 preferably contacts directly against the elbow 156. If desired, one or more loops of cord 94 can be wrapped around the elbow 156. If desired, the elbow 156 and heating element cord 94 can be constructed and arranged such that a portion of the cord 94 is immersed directly in the hot melt mix material.

Preferably, the construction, arrangement and spacing, a, of the three phase heating element cord 94 wrapped helically about the exterior of the hot melt mix flow tube 142 of the wand 24 is substantially the same as the heating element cord 94 wrapped about the hose 22 previously described herein and hence will not be further described.

IV. Three Phase Heating Element System, Circuit and Control

Figure 6:
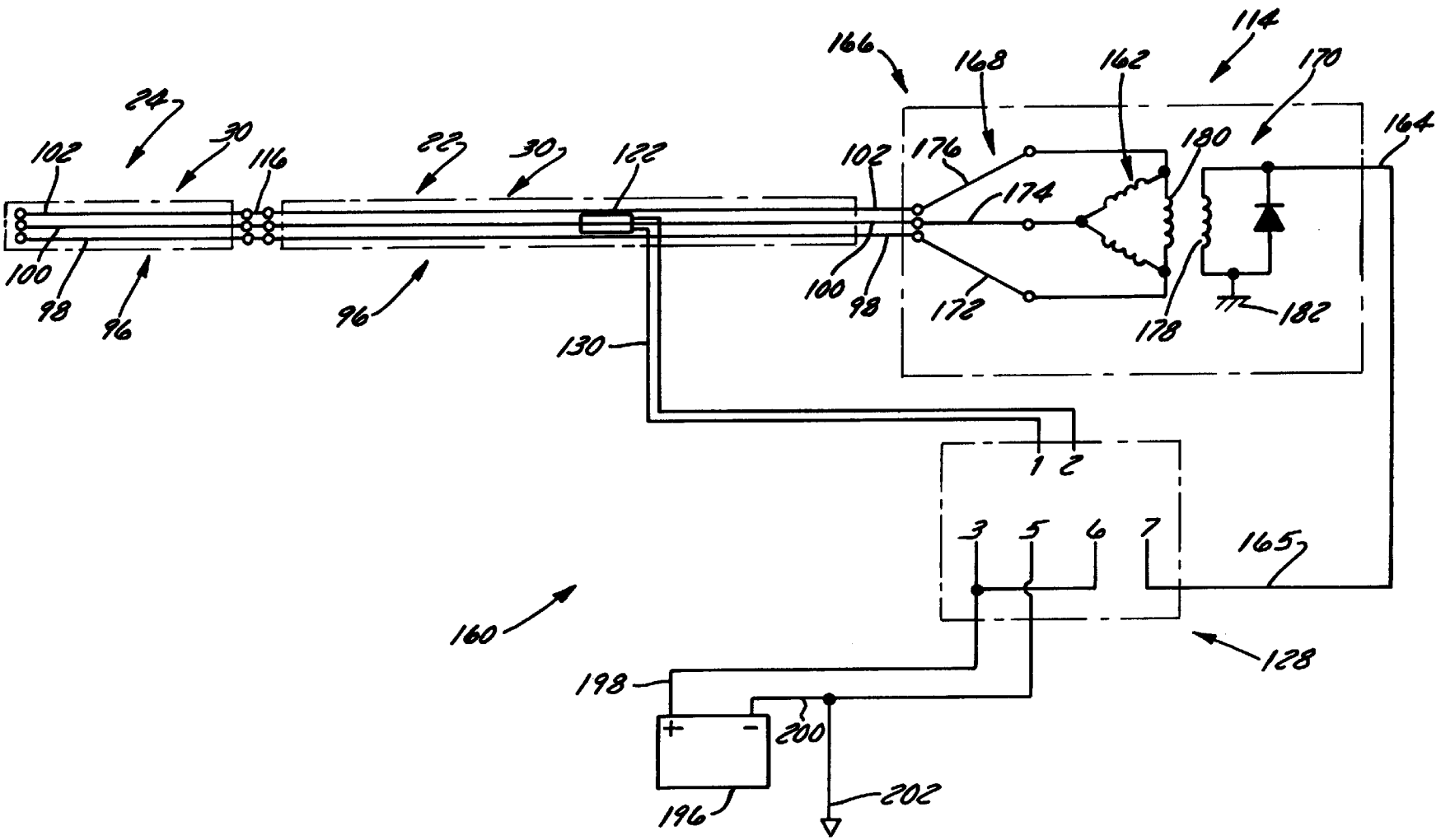
FIG. 6 is a schematic view of the heating element and control circuit for controlling the application of current to the heating element of the hose and wand.

FIG. 6 illustrates a three phase heating system 160 for controllably supplying heat preferably to both the hose 22 and wand 24 to heat and maintain hot melt mix material in both the hose 22 and wand 24 at a temperature at which the material can flow. The three phase heating system 160 is comprised of an electrical circuit 160 that includes the three phase power source 114 coupled to the three phase heating element cord 94 of the hose 22 and wand 24, with the operation of the power source 114 and heating element 30 controlled by the temperature controller 128. As is shown in FIG. 6, the heating element cord 94 of the hose 22 is connected in series to the heating element cord 94 of the wand 24.

A. Three Phase Power Source

Preferably, the three phase power source 114 is a delta three phase power source 162, as is shown in FIG. 6. Alternatively, for example, the power source 162 can be a wye three phase power source (not shown). To selectively control application of power to the heating element 30, the three phase power source 162 has a control input 164 in communication with a control output 165 of the temperature controller 128 that enables the controller 128 to selectively control operation of the heating element 30 by directly controlling operation of the power source 114.

As is shown in FIG. 6, the power source 114 preferably comprises a three phase generator 166 having a stator 168 in electrical communication with the heating element 30 and a rotor 170 connected to the control input 164. The generator control input 164 is connected to the temperature controller control output 165 for enabling the operation of the generator 166 to be directly controlled. The stator 168 is constructed and arranged in a delta configuration 162 having an output terminal 172 connected to heating element wire 98 of the heating element cord 94, another output terminal 174 connected to heating element wire 100, and a still further output terminal 176 connected to heating element wire 102.

The rotor 170 has a winding 178 in magnetic field communication with a winding 180 of the stator 168 with one leg of the winding 178 connected to a ground 182 and another leg of the winding 178 connected to the temperature controller output 165. To prevent reverse flow of current around the rotor winding 178, there is a diode 184 connected in parallel with the winding 178 to the control input 164.

In the control of the operation of the generator 166, the stator 168 is energized upon application of current from the temperature controller output 165 to the rotor input 164, thereby causing the generator 166 to generate and supply three phase electrical power to the three phase heating element 30 of the hose 22 and wand 24. When no control current is applied to the rotor 170 by the temperature controller 128, no electrical power is generated by the generator 166. Therefore, when the temperature controller 128 desires to stop the heating element 30 from supplying heat to the hose 22 and wand 24, the controller 128 simply ceases supplying control current to the rotor 170. In this manner, the amount of heat applied to the hose 22 and wand 24 can be advantageously controllably regulated in a relatively precise fashion.

When control current from the temperature controller 128 is applied to the rotor 170, the current causes the rotor winding 178 to generate a magnetic field which communicates with the stator winding 180 thereby causing electrical power to be generated. In this manner, control current energizes the stator 168 causing it to produce electrical current. When no control current is applied, no magnetic field is created, and no power is generated.

Figure 7:
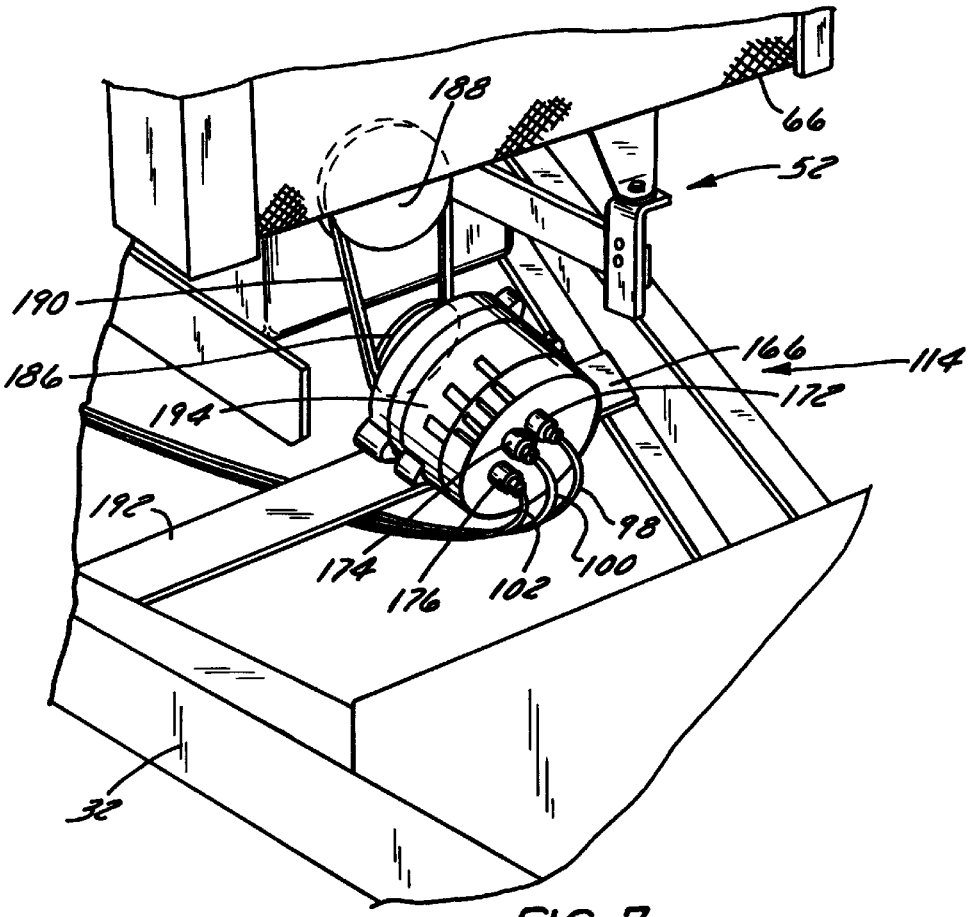
FIG. 7 is a partial fragmentary perspective view of an internal combustion engine of the applicator coupled to a generator for providing electrical power to the heating element.

Referring additionally to FIG. 7, the generator 166 has a pulley 186 on its input shaft coupled to a pulley 188 on a drive shaft of the engine 52 by an endless flexible belt 190. The generator 166 is carried by a bracket 192 affixed to the support frame 32 and has three outputs 172, 174 and 176, one for each phase of the power delivered to the heating element wires 98, 100 and 102.

Preferably, the generator 166 is a modified vehicle alternator 194 coupled to the engine 52 in the manner shown in FIG. 7. Preferably, the alternator 194 is modified so that it produces three phase current across its output terminals 172, 174 and 176. Preferably, the alternator 194 is a conventional vehicle alternator modified such that its rectifier and voltage regulator circuitry are not required, with electrical power being delivered directly from the alternator 194 to the heating element cord wires 98, 100 and 102 without needing to be regulated by any voltage or current regulator.

The alternator 194 preferably can be a modified claw-pole type alternator, although the alternator can be of compact alternator construction, can be a salient pole alternator, can be an alternator having a windingless rotor, or can be another type of generator capable of generating three phase electrical power. Preferably, the alternator 194 is a Southwest Products Model No. 333 alternator to produce three phase current. Such an alternator 194 preferably produces no greater than about sixty volts and at least about twenty volts and several amperes of electrical power during operation to cause the heating element 30 to generate a desired amount of heat to achieve and maintain the flowability of hot melt mix material within the hose 22 and wand 24. In a preferred embodiment, the alternator 194 preferably produces about thirty six volts at generally optimum operating conditions. Of course, loading on the engine by the hydraulic pump and other engine loads can cause some fluctuations in output voltage. Alternatively, the output voltage and amperage of the alternator 194 can be more or less dependent upon the construction of the alternator 194, the output speed of the engine 52, the load on the alternator 194 produced by the heating element 30, as well as other factors.

B. Temperature Controller

The temperature controller 128 is shown in block form in FIG. 6 with numbered pinouts depicting the various input and output connections of the controller 128. During operation, the temperature controller 128 communicates with the temperature sensor 122 affixed to the hose 22 and energizes or deenergizes the generator 166 in response to the hose/hot melt mix temperature sensed by the sensor 122. If the hot melt mix temperature is high enough, indicating that hot melt mix material within the hose 22 is at a temperature at which it will suitably flow, the generator 166 is not energized or is deenergized thereby causing the generator 166 to supply no electrical power to the heating element 30. Should the hot melt mix temperature drop below a predetermined value indicating that hot melt mix material within the hose 22 (1) is not at a temperature at which it will easily flow, or (2) is approaching a temperature below which it will not easily flow, the temperature controller 128 preferably energizes the generator 166 to cause electrical power to be supplied to the heating element 30 so that the hose 22 and wand 24 will be suitably heated to help ensure flowability of the hot melt mix material.

To supply power to the controller 128, the controller 128 is connected to a power source 196 that preferably is a direct current power source, such as a battery of conventional construction or the like. As is shown in FIG. 6, a positive terminal 198 of the battery is connected to pins 3 and 6 of the temperature controller 128 for supplying electrical power to the controller 128. A negative terminal 200 of the battery 196 is connected to a ground 202 that preferably can be in electrical communication with the rotor ground 182. In addition to being connected to the ground 202, the negative terminal 200 of the battery 196 is also connected to pin 5 of the temperature controller 128.

Figure 6A:
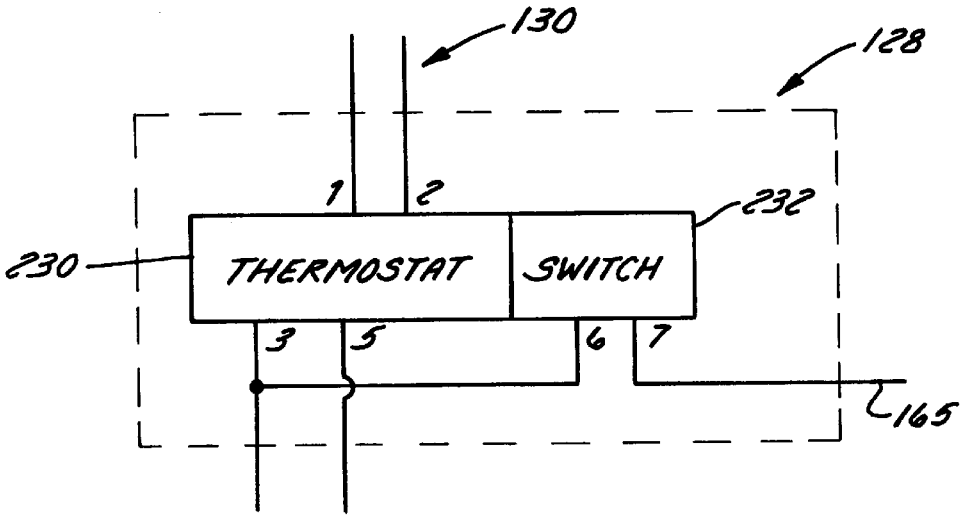

One wire 130 of the temperature sensor 122 is connected to pin 1 of the temperature controller 128 and the other wire 130 of the sensor 122 is connected to pin 2 of the controller 128 for enabling the controller 128 to communicate with the sensor 122. To control operation of the generator 166 based upon the sensed hot melt mix temperature, pin 7 of the controller 128 is the output 165 that is connected to the control input 164 of the generator 166. Preferably, pins 1 and 2 of the controller 128 extend from an integral thermostat circuit 230 (FIG. 6A) of the controller 128 which has a switching mechanism 232 (FIG. 6A), such as a conventional switch, a solid state switch, a relay or the like, for enabling a control current to be selectively delivered the rotor input 164 when the hot melt mix hose temperature is too low. Preferably, the switching mechanism 232 of the controller thermostat circuit 230 delivers control current directly or indirectly from the battery 196 to the controller output 165 which communicates the control current to the control input 164 of the generator 166.

Figure 8:
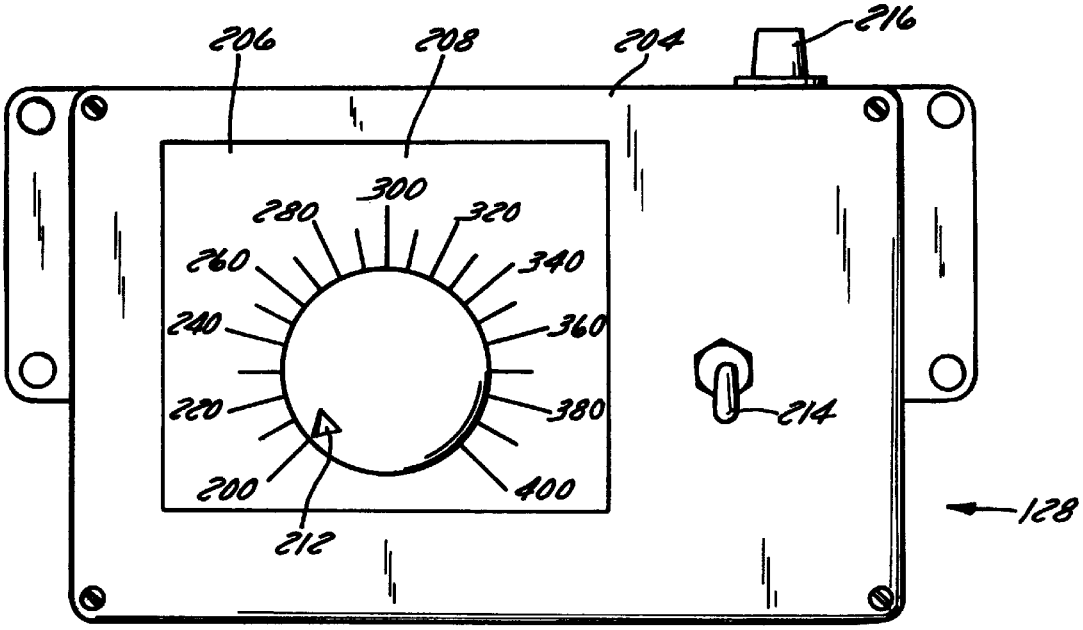
FIG. 8 is an enlarged front view of a control box for housing a temperature controller of the heating element and control circuit.

Referring additionally to FIG. 8, the temperature controller 128, including its accompanying internal circuitry, is received in a control box 204 that is affixed to the exterior of the kettle 38. If desired, the battery 196 can also be received within the control box 204. To activate the controller 128, the box 204 has an "on/off" switch 214 and an indicator light 216 on top of the box 204. Preferably, the indicator light 216 is lit when the switch 214 is switched to its "on" position.

As is shown in FIG. 8, mounted on the face of the control box 204 is an indicator label 206 indicating a plurality of control temperature settings that the controller 128 can be set at during operation. The label 206 has a plurality of control temperature settings 208 arranged in a semicircle around a control knob 210. In a preferred embodiment, as is depicted in FIG. 8, the temperature settings 208 range from 200° Fahrenheit (° F.) to 400° F. and have intermediate temperature intervals of 10° F. marked by radially outwardly emanating lines on the face of the label 206. Alternatively, depending upon the range of control temperatures desired, limitations of the controller 128, the material being heated and applied, the flow rate of the material flowing through the hose 22 and wand 24, as well as other factors, the label 206 may bear a different temperature range. Routine testing and experimentation can be done to determine an optimum temperature range for different hot melt materials, different applications, different flow rates, different operating conditions, and for other factors.

The control knob 210 has an indicator arrow 212 which indicates the desired control setting of the temperature controller 128. To communicate the control setting to the temperature controller thermostat circuitry, the knob 210 preferably is attached to a shaft of an electrical component capable of selectively variable control that preferably is a variable resistor, a potentiometer, or the like, which sets the desired control temperature for the controller 128.

Alternatively, another means for setting the control temperature can be used. For example, a digital or analog input for inputting the control temperature can be used. If a digital input is used, it can, for example, comprise a pair of push buttons coupled to a digital readout that allows the control temperature to be increased when one of the buttons is pushed and to be decreased when the other of the buttons is pushed.

In one preferred embodiment of the temperature controller 128, selection of a control temperature using the knob 210 controls when the generator 166 is energized thereby controlling heating of the hose 22, wand 24 and hot melt mix material within the hose 22 and wand 24. For example, if the knob 210 is set to a control temperature of 200° F., such as is depicted in FIG. 8, the controller 128 can be programmed to energize the generator 166 when the hot melt mix hose temperature sensed by the thermocouple 122 and controller 128 drops to either (1) the control temperature or (2) to a predetermined temperature below the control temperature.

If the controller 128 is preprogrammed to energize the generator 166 when the hot melt mix temperature is below the control temperature, it can be preprogrammed to energize when the hot melt mix temperature reaches a certain preset temperature below the control temperature. For example, the controller 128 preferably can be preprogrammed or preset such that it energizes the generator 166 when the hot melt mix temperature is five, ten, fifteen or even twenty degrees below the control temperature.

Likewise, the controller 128 can be preprogrammed to deenergize the generator 166 when the hot melt mix temperature rises to be the same as the control temperature or when it reaches a temperature above the control temperature. In a preferred embodiment, the controller 128 deenergizes the generator 166 when the sensed hot melt mix hose temperature rises to a predetermined temperature above the control temperature. For example, the controller 128 can be preprogrammed or preset such that it deenergizes the generator 166 when the hot melt mix temperature is at a temperature that is five, ten, fifteen or even twenty degrees above the control temperature.

As such, the controller 128 can be programmed to have an upper setpoint control temperature that is above the control temperature set by the user 28 and a lower setpoint control temperature that can be the same as or below the control temperature set by a user 28 for enabling the controller 128 to control generator operation such that the hose 22, wand 24 and hot melt mix material within the hose 22 and wand 24 are sufficiently heated during operation. Preferably, these upper and lower setpoint temperatures "float" around or are indexed to the control temperature set by the user 28.

Preferably, the controller 128 has a thermostat circuit 230 of conventional construction for providing an upper and lower setpoint temperature that is tied to the control temperature set by the user 28. Preferably, the controller 128 is a PAKSTAT Model No. P64A0918904, made by Paktronics Controls, Inc. of Fort Worth, Tex. and which provides these capabilities. Alternatively, the controller 128 can be another type of controller, such as for example a programmable controller capable of controlling generator operation based upon the sensed temperature of one or more of the following: the hose 22, the wand 24, the hose 22 and wand 24, the hot melt mix material within the hose 22 and/or wand 24, or a suitable combination thereof.

V. Engine Control

Figure 9:
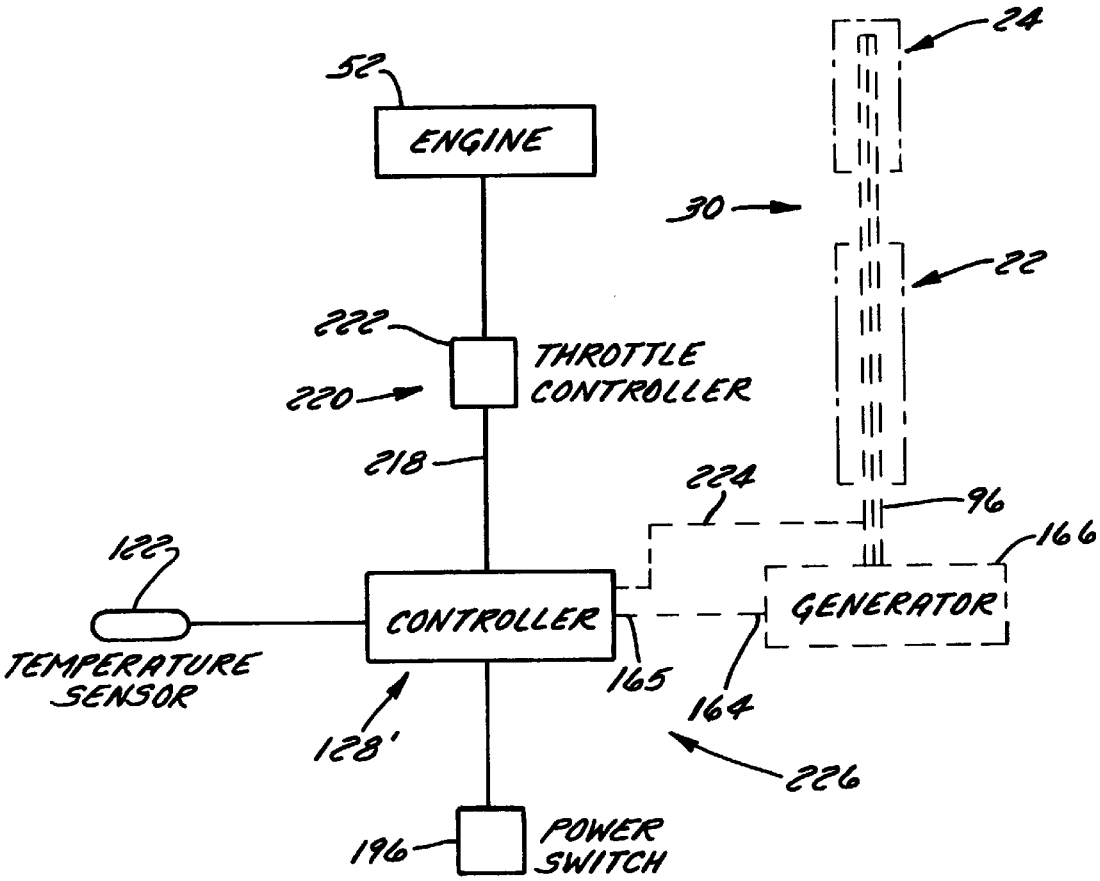
FIG. 9 is a block diagram depicting a second control system of this invention for regulating heat input to the hose and wand by regulating engine speed thereby regulating generator output.

As is depicted in FIG. 9, in another preferred embodiment of the controller 128', the controller 128' can be constructed and arranged to perform as part of an engine control system 226 to control operation of the engine 52 to help regulate the temperature of the hot melt mix material within the hose 22 and wand 24. To control operation of the engine 52, the controller 128' has a control line 218 in communication with an engine controller 220 that preferably is a throttle controller 222. Preferably, the throttle controller 222 selectively controls the speed of the engine 52 by directly controlling the position of the throttle of the engine 52 during operation. By directly controlling the speed of the engine 52 during operation, the amount of electrical power generated and supplied to the hose 22 and wand 24 can also be controlled thereby enabling heat input into the hose 22 and wand 24 to be regulated.

Preferably, the throttle controller 222 is a solenoid operably connected to the throttle of the engine 52, such as by being connected to the throttle cable of the engine 52 or the like. In response to a control signal from the controller 128 sent along control line 218, the throttle controller 222 changes position of the engine throttle by the solenoid being energized and moving the throttle. If desired, the control signal of the controller 128' can be directly applied to the solenoid itself to selectively control the position of the throttle. Alternatively, the throttle controller 222 can be integral with the controller 128'.

If desired, the speed of the engine 52 can be controlled and based upon the hot melt mix temperature sensed by the temperature sensor 122 with engine speed being increased if the sensed temperature is too low and being decreased if it is higher than necessary. For example, engine speed can be increased or decreased relative to a control temperature set and regulated in the manner discussed above.

Preferably, the speed of the engine 52 can be controlled based upon the load placed upon the generator 166 to ensure adequate electrical power is being supplied to the heating element of the hose 22 and wand 24. In one preferred embodiment, the controller 128' has a line 224 (in phantom) in electrical communication with one or more of the output terminals 172, 174, and 176 of the generator 166 or the heating element wires 98, 100 and 102 for sensing (1) voltage, (2) amperage, or (3) both voltage and amperage to ensure that the heating element 30 is generating an appropriate amount of heat for a given set of operating conditions.

If the electrical measurement sensed is too low, such as below a setpoint control voltage or current, the controller 128' speeds up the engine 52 to cause the generator 166 to output more electrical power to the heating element 30. Conversely, if the electrical measurement is too high, such as above a setpoint control voltage or current, the controller 128' reduces engine speed to cause less electrical power to be delivered to the heating element 30 thereby causing less heat to be applied to the hose 22 and wand 24.

In one preferred embodiment, the controller 128' regulates engine speed based upon the sensed output voltage of the generator 166. If, the output voltage should fall below a desired predetermined output voltage, the controller will increase engine speed thereby increasing the output voltage until it reaches or suitably exceeds the desired voltage. Conversely, if the output voltage is too great, the engine 52 is slowed preferably until the output voltage approaches or falls within an acceptable range of the desired preset voltage. In one preferred embodiment, the output voltage of the generator 166 is, for example, about thirty six volts for ensuring a heating element heating flux of about of about 3.5 watts per inch$^2$.

Additionally, the controller 128' can also function as temperature controller 128 by also controlling the operation of the generator 166 in the manner previously discussed. In combination, in response to the hot melt mix temperature and electrical output of the generator 166, the engine speed and generator operation can be suitably controlled to control heating of the hose 22 and wand 24 in a carefully controlled manner over a wide range of operating conditions and the like.

VI. Use and Operation

A. Use

In use, the three phase hose and wand heating system 160 of this invention, including the three phase generator 166, three phase heating element 30 and controller 128, is well suited for controlling the heating of the hose 22 and wand 24 of a hot melt mix applicator 20 that can dispense hot melt materials such as bitumen, tar, asphalt, asphalt mixtures, petroleum based mixtures, petroleum based sealants, thermoplastic sealants, thermoplastic paints, thermoplastic plastics, other thermoplastic materials and other materials which can be made flowable upon the application of heat. Preferably, the heating system 160 is particularly well suited for use in conventional hot melt mix applicators, asphalt dispensers, pavement crack sealing machines, and other types of thermoplastic material dispensers and applicators that use a hose 22, a wand 24, or both a hose 22 and wand 24 to effect dispensing of the thermoplastic material. Although well suited for use to heated mixtures of two or more materials, the wand and hose heating system 160 of this invention is also well suited for heating hot melt materials that are not mixtures. The engine speed control system 226 of this invention is also particularly well suited for these applications.

B. Operation

In preparation for startup, the switch 214 of the temperature controller 128 is turned to its "on" position and the control knob 210 is set at a desired control temperature for the particular material being applied by the hot melt mix applicator 20. Upon startup of the applicator 20, hot melt mix material inside the kettle 38, inside the hose 22 and inside the wand 24 is heated to or preferably above a temperature at which the hot melt mix material will flow.

To do this, the engine 52 is started, enabling three phase electrical power to be generated by the three phase generator 166. To determine whether the generator 166 will be energized, the temperature controller 128 communicates with the temperature sensor 122 to determine the temperature of the hose 22 and hot melt mix within the hose 22 that is adjacent the sensor 122. If the temperature is below the control temperature or below its lower setpoint temperature, the generator 166 is energized by the controller 128 causing current flow in each of the three phase heating element wires 98, 100 and 102 which heats the hose 22 and wand 24.

As the hot melt mix material within the hose 22 and wand 24 is heated, the hot melt mix material begins to melt making it flowable. After a sufficient heating interval of time has elapsed, the hot melt mix within both the hose 22 and wand 24 will be sufficiently hot such that it will flow. Preferably, when the hot melt mix material within the hose 22 and wand 24 has reached a flowable state and the temperature controller 128 senses that the hot melt mix temperature has reached the upper setpoint temperature, the controller 128 deenergizes the generator 166 thereby ceasing current flow to the heating element 30.

If desired, the controller 128 can provide a signal to the operator 28, in the form of an indicator light or otherwise (not shown), that the hot melt mix material within the hose 22 and wand 24 have reached the desired temperature and is in a flowable state. If desired, to expedite heating of the hot mix material during startup until it reaches a flowable state, the controller 128 can communicate with the engine 52 to cause the engine 52 to run at least slightly faster than normal.

In operation, as hot melt mix material is pumped from the kettle 38, it flows through the hose 22 and is dispensed from the duckbill valve 72 at the end of the wand 24 onto a surface that preferably is pavement, roadway or the like. Should the temperature of the hot melt mix material within the hose 22 drop below the lower control temperature or lower setpoint temperature, the controller 128 activates the generator 166 thereby supplying current to each of the wires 98, 100 and 102 of the heating element 30 causing hot melt mix material within the hose 22 and wand 24 to be heated. When the temperature of the sensor 122 reaches the upper setpoint temperature, the controller 128 deenergizes the generator 166 ceasing current flow to the heating element 30.

The control system 160 is particularly well suited for keeping the hot melt mix material within the hose 22 and wand 24 in a flowable state during periods of inactivity, such as when the applicator 20 is operating but no hot melt mix is being dispensed. When the applicator 20 is operating and no hot melt mix is being dispensed, hot melt mix is not flowing through the hose 22 and wand 24 and can therefore cool within the hose 22 and wand 24 causing some solidification. During these periods, the three phase heating system 160 advantageously maintains the hot melt mix material at a temperature at which it will readily flow despite the cooling that ordinarily takes place.

Although the aforementioned heating system 160 is designed to controllably heat both the hose 22 and wand 24, it is within the contemplated scope of the invention to modify the system 160 to controllably heat only the hose 22, only the wand 24, or both the hose 22 and wand 24 independently of each other. If heated independently of each other, the hose 22 preferably has its own heating element and temperature sensor and the wand 24 preferably has its own heating element and sensor, with current flow controlled such that it can be delivered to one of the heating elements independently of the other heating elements.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims and the applicable prior art.

What is claimed is:

1. A heated flowable material applicator comprising:

a) a source of heated flowable material;

b) a dispenser for dispensing heated flowable material from said source;

c) a hose having one end in fluid flow communication with said source of heated flowable material and its other end in fluid flow communication with said dispenser for permitting the passage of heated flowable material from said source to said dispenser wherein said hose comprises:

1) an elongate tubular and noncorrugated casing extending substantially the axial length of said hose;

2) an elongate flexible conduit received within said casing;

3) a section of axially compressible and axially expandable flexible tubing slidably received within said conduit permitting relative movement therebetween; and 4) a pair of spaced apart fitting assemblies with one of said fitting assemblies operably attached to said conduit adjacent one end of said conduit and the other of said fitting assemblies operably attached to said conduit adjacent the other end of said conduit with said casing immovably fixed at or adjacent one end of said casing to one of said fitting assemblies and said casing immovably fixed at or adjacent the other end of said casing to the other of said fitting assemblies wherein hose tension is transmitted between said fitting assemblies substantially through said casing; and d) a pump for urging heated flowable material through said hose to said dispenser; and e) an elongate electric heating element carried by said hose for heating flowable material in said hose.

2. The heated flowable material applicator of claim 1 wherein there is a loose or sliding fit between said tubing and said conduit for enabling said tubing to move within said conduit relative to said conduit when said hose is bent.

3. The heated flowable material applicator of claim 1 wherein said tubing has an uncompressed length greater than the length of said conduit.

4. The heated flowable material applicator of claim 1 wherein said tubing comprises a single elongate strip of metal helically wound into a generally cylindrical and elongate tube sidewall that 1) is resistant to radially inwardly directed forces tending to crush said tubing for reinforcing said conduit against crush, 2) can be bent in an arc having a radius of curvature of no less than one inch to prevent kinking of said conduit, 3) can axially compress or axially expand for moving relative to said conduit to accommodate bending of said tubing and said conduit substantially simultaneously, and 4) is hollow for permitting flowable material to flow through said tubing.

5. The heated flowable material applicator of claim 4 wherein said elongate metal strip has a 1) a pair of spaced apart edges with one of said edges comprising a flange bent in one direction and the other of said edges comprising a flange bent in another direction, 2) a ridge between said edges for making said tubing stiffer and resistant to crush, 3) a flat portion adjacent said ridge and one of said flanges for enabling said tubing to axially compress and expand, and wherein said strip is shaped to form a plurality of adjacent helical coils with one of said flanges of one of said adjacent coils engaged with the other of said flanges of the other of said adjacent coils.

6. The heated flowable material applicator of claim 5 wherein said metal strip is comprised of aluminum.

7. The heated flowable material applicator of claim 1 wherein said tubing is comprised of helically coiled metal.

8. The heated flowable material applicator of claim 7 wherein said conduit has an inner liner and an outer sleeve of a flexible woven or braided material encasing said liner.

9. The heated flowable material applicator of claim 8 wherein said liner is comprised of tetrafluoroethylene and said sleeve is comprised of nylon.

10. The heated flowable material applicator of claim 1 wherein said casing comprises the exterior of said hose and said casing comprises a rubber sidewall and a helical metal wire embedded in said sidewall wherein said wire extends substantially the axial length of said casing.

11. The heated flowable material applicator of claim 10 wherein said casing comprises a bellowsflex-type hose constructed and arranged to limit the radius of curvature of a bend of said casing to no less than one and one-half inch to preventing kinking.

12. The heated flowable material applicator of claim 1 wherein each said fitting assembly comprises 1) a swivel fitting having i) a housing received inside said casing for insulating said swivel fitting and ii) a threaded fitting carried by said housing that is constructed and arranged to rotate relative to said housing, and 2) a transition fitting received inside said casing and having i) a nipple at one end fluidtightly received in said conduit and ii) a threaded fitting at its other end threadably engaged with said swivel housing.

13. The heated flowable material applicator of claim 12 further comprising a generally cylindrical collar adjacent each end of said hose crimped around said casing urging said casing against said swivel fitting housing and immovably fixing said casing to said fitting assembly.

14. The heated flowable material applicator of claim 13 wherein said electric heating element is disposed in thermal communication with said conduit for heating said heated flowable material in said conduit and wherein said heating element comprises at least two elongate insulated wires for carrying electrical current with said wires entering said hose adjacent one end of said hose through a bore in said casing wherein one of said collars extends from adjacent the end of said hose axially beyond said casing bore to oppose flexing of said casing adjacent said casing bore to prevent cracking or tearing of said casing at or adjacent said casing bore.

15. The heated flowable material applicator of claim 1 wherein said inner diameter of said casing is larger than the outer diameter of said conduit providing an annular insulating air gap between said casing and said conduit.

16. The heated flowable material applicator of claim 1 wherein said heating element comprises at least two elongate wires for carrying electrical current arranged in a spiral exteriorly of said tubing and interiorly of said casing substantially the length of said conduit.

17. The heated flowable material applicator of claim 16 wherein said electrical current source comprises a three phase current source and said heating element comprises three elongate wires each carrying a phase of electrical current wherein said heating element wires are wrapped in a spiral around said conduit substantially the axial length of said conduit.

18. The heated flowable material applicator of claim 17 further comprising a frame carrying said source of heated flowable material and said pump, and further comprising a source of electrical current electrically connected to said heating element that includes an internal combustion engine carried by said frame mechanically coupled to an alternator that 1) lacks any voltage regulator and 2) lacks any current regulator, said alternator electrically coupled to said heating element.

19. The heated flowable material applicator of claim 18 wherein said source of heated flowable material comprises a kettle of heated hot melt mix and wherein one end of said hose is coupled to said kettle and the other end of said hose is coupled to said dispenser.

20. The heated flowable material applicator of claim 19 wherein said hot melt mix comprises one of bitumen, tar, and asphalt.

21. A heated flowable material applicator comprising:

a) a source of heated flowable material;

b) a dispenser for dispensing said heated flowable material;

c) a hose having one end in fluid flow communication with said source of heated flowable material and its other end in fluid flow communication with said dispenser for facilitating passage of said heated flowable material from said source to said dispenser wherein said hose comprises:

1) an elongate tubular flexible and noncorrugated casing extending substantially the axial length of said hose;

2) an elongate flexible tubular conduit received within said casing;

3) a pair of fitting assemblies with one of said fitting assemblies fluidtightly coupled to said conduit at one end of said conduit and the other of said fitting assemblies fluidtightly coupled to said conduit at the other end of said conduit;

4) a section of flexible axially compressible and axially expandable tubing that slidably telescopically cooperates with said conduit such that i) said tubing and said conduit are generally coaxial, and ii) said tubing is slidably movable relative to said conduit; and 5) wherein said casing is immovably fixed at one end to one of said fitting assemblies and is immovably fixed at its other end to the other of said fitting assemblies; and d) a pump for urging heated flowable material through at least said conduit;

e) a source of electrical current;

f) an electric heating element electrically connected to said current source;

g) wherein said electric heating element 1) is received between said casing and said conduit and 2) extends substantially the axial length of said conduit for heating flowable material within said conduit or said tubing.

22. The heated flowable material applicator of claim 21 further comprising a frame carrying said source of heated flowable material, said pump and said source of electrical current, wherein 1) said source of electrical current comprises an internal combustion engine mechanically coupled to a generator, and 2) said elongate heating element comprises at least two wires wrapped in a spiral around said conduit for heating flowable material in said conduit or said tubing.

23. The heated flowable material applicator of claim 22 wherein said generator comprises an automotive alternator generating three phase electric current and said heating element comprises a three phase heating element having at least three wires.

24. The heated flowable material applicator of claim 21 wherein said tubing section comprises a single elongate strip arranged in a helically coiled generally cylindrical and elongate tube sidewall that permits said tubing section to axially compress or axially expand wherein said tubing section is received in said conduit and is movable relative to said conduit to accommodate substantially simultaneous bending of said tubing and said conduit.

25. The heated flowable material applicator of claim 24 wherein said elongate strip comprises 1) a pair of spaced apart edges with one of said edges comprising a first flange angled in one direction and the other of said edges comprising a second flange angled in another direction relative to the first flange, 2) a radially extending lengthwise ridge between said edges for making said tubing stiffer and resistant to crush, 3) a flat disposed between said ridge and at least one of said flanges for enabling said tubing section to axially compress and expand, and wherein when coiled to form said cylindrical tube sidewall said strip is formed into a plurality adjacent helical coils with one of said flanges of one of said adjacent coils engaged with the other of said flanges of the other of said adjacent coils.

26. The heated flowable material applicator of claim 25 wherein said casing comprises a sidewall of a flexible and resilient material having a wire comprised of a material stiffer than said sidewall embedded in said sidewall.

27. The heated flowable material applicator of claim 26 wherein said casing is comprised of a bellowsflex hose.

28. A heated flowable material applicator comprising:

a) a source of heated flowable material;

b) a dispenser for dispensing heated flowable material from said source;

c) a hose having one end in fluid flow communication with said source of heated flowable material and its other end in fluid flow communication with said dispenser for facilitating passage of said heated flowable material from said source to said dispenser wherein said hose comprises:

1) an elongate tubular flexible casing extending substantially the axial length of said hose;

2) an elongate flexible tubular conduit received within said casing;

3) a pair of fitting assemblies with one of said fitting assemblies fluidtightly coupled to said conduit at one end of said conduit and the other of said fitting assemblies fluidtightly coupled to said conduit at the other end of said conduit;

4) an elongate section of flexible and axially compressible tubing slidably telescopically received within said conduit such that said axially compressible tubing section can move relative to said conduit and wherein said axially compressible tubing section has an uncompressed length that is longer than the length of said conduit; and 5) wherein said casing is fixed at or adjacent one end to one of said fitting assemblies and fixed at or adjacent its other end to the other of said fitting assemblies; and d) a pump for urging said heated flowable material through one of said tubing section and said conduit to said dispenser.

29. The heated flowable material applicator of claim 28 further comprising a source of electrical current and an elongate heating element comprised of at least two wires for carrying electrical current, wherein the heating element is wrapped in a spiral around said conduit substantially along the length of said tubing for heating flowable material in one of said tubing section and said conduit.

30. A flexible hose for a heated flowable material applicator comprising a tubular casing, a tubular flexible conduit received inside said casing, and a section of axially compressible flexible tubing received inside said conduit, and an electric heating element comprised of at least two elongate wires disposed between said casing and said conduit, and wherein said tubing section is axially longer than said conduit before being received completely inside said conduit and at least a portion of said tubing section is slidably telescopically movable relative to said conduit when received within said conduit.

31. The hose of claim 30 further comprising a pair of fitting assemblies with one of said fitting assemblies attached to one end of said conduit and the other of said fitting assemblies attached to the other end of said conduit wherein said casing is immovably fixed at one end to one of said fitting assemblies and is immovably fixed at its opposite end to the other of said fitting assemblies.

32. The hose of claim 30 wherein said tubing comprises a thin strip of metal formed into a plurality of adjacent coils defining a tube with adjacent edges of adjacent coils engaging each other.

33. A method of making a hose for a heated flowable material applicator comprising:

a) providing a tubular flexible casing, a tubular conduit, a section of flexible metal tubing having a length longer than the conduit, and a pair of fittings, and a heating element comprised of at least two wires;

b) engaging one of the fittings with one end of the conduit;

c) urging the section of tubing slidably telescopically into the conduit and axially compressing the section of tubing until the section of tubing is completely received within the conduit;

d) engaging the other of the fittings with the other end of the conduit; and e) disposing the heating element wires in contact with the conduit; and f) urging the conduit slidably telescopically into the casing.

34. The method of claim 33 further comprising the step of immovably fixing one end of the casing to one of the fittings and immovably fixing the other end of the casing to the other of the fittings.

35. The method of claim 34 comprising providing a pair of collars and crimping one of the collars to the casing adjacent one end of the casing to immovably fix the casing to one of the fittings and crimping the other of the collars to the casing adjacent its other end to immovably fix the casing to the other of the fittings.

36. The heated flowable material applicator of claim 1 wherein said tubing section has an axially uncompressed length that is longer than the length of said conduit.

37. The heated flowable material applicator of claim 36 wherein said tubing section is axially compressed to a length no greater than the length of said conduit when it is received in said conduit.

38. The heated flowable material applicator of claim 21 wherein said tubing section has an axially uncompressed length that is longer than the length of said conduit.

39. The heated flowable material applicator of claim 38 wherein said tubing section is axially compressed to a length no greater than the length of said conduit and is received in said conduit.

40. The heated flowable material applicator of claim 28 wherein said tubing section is axially compressed to a length no greater than the length of said conduit when it is received in said conduit.

41. A heated flexible hose for a flowable material applicator comprising:

a) a pair of spaced apart fittings, a tubular flexible casing having one end attached to one of said fittings and its other end attached to the other one of said fittings;

b) a tubular flexible conduit received inside said casing having one end in fluid flow communication with one of said fittings and its other end in fluid flow communication with the other one of said fittings;

c) a section of axially compressible flexible and corrugated tubing received inside said casing, said corrugated tubing section slidably telescopically cooperating with said conduit such that 1) said corrugated tubing section and said conduit are generally coaxial, and 2) said corrugated tubing section is slidably movable relative to said conduit;

d) wherein said corrugated tubing section has an uncompressed length that is longer than the length of said conduit and said corrugated tubing section is axially compressed to a length less than said uncompressed length when received inside said casing; and e) wherein a flowable material flows through said conduit.

42. The hose of claim 41 wherein said conduit is comprised of a woven or braided sidewall lined with tetrafluoroethylene and further comprising a heating element in contact with said conduit for heating said flowable material while inside said conduit.

43. The hose of claim 42 wherein corrugated tubing section is received inside said conduit and is axially compressed to a length no greater than the length of said conduit and said flowable material flows through said corrugated tubing section.

44. The hose of claim 43 wherein said corrugated tubing section is formed by helically winding and edgewise binding of a thin metal strip.

45. A flexible hose for a heated flowable material applicator comprising:

a) a pair of spaced apart swivel fitting assemblies with each one of said swivel fitting assemblies comprising a housing having a fitting extending outwardly from one end of said housing and a swivel disposed at the other end of said housing;

b) an inner tubular flexible conduit having 1) one end operably coupled to one of said fitting assemblies adjacent said swivel of said one of said fitting assemblies and 2) its other end operably coupled to the other one of said fitting assemblies adjacent said swivel of said the other one of said fitting assemblies;

c) a tubular flexible and noncorrugated outer casing 1) immovably fixed at or adjacent one end to said housing of one of said fitting assemblies and 2) immovably fixed at or adjacent its other end to said housing of the other one of said fitting assemblies;

d) a heating element received inside said casing and in contact with said conduit for heating a flowable material disposed inside said conduit;

e) a pair of spaced apart collars with 1) one of said collars i) disposed around a portion of said swivel for insulating said swivel, and ii) attached to said housing of one of said swivel fitting assemblies, and 2) the other one of said collars i) disposed around at least a portion of said swivel for insulating said swivel, and ii) attached to said housing of the other one of said swivel fitting assemblies; and f) wherein 1) said flexible conduit is disposed inside said outer casing, 2) said fitting of one of said swivel fittings extends outwardly from the hose, 3) said fitting of the other one of said swivel fittings extends outwardly from the hose, and 4) hose tension is transmitted between said swivel fitting assemblies through said casing.

46. The hose of claim 45 wherein said casing is immovably affixed at one end to said housing of one of said swivel fitting assemblies by one of said collars and said casing is immovably affixed at its other end to said housing of the other one of said swivel fitting assemblies.

47. The hose of claim 45 wherein said swivel of one said swivel fitting assemblies is received within said casing and said swivel of the other one of said swivel fitting assemblies is received within said casing.

48. The hose of claim 45 wherein said conduit comprises a woven or braided outer wall and a flexible inner liner.

49. The hose of claim 48 further comprising a section of axially compressible flexible tubing having an uncompressed length longer than the length of said conduit wherein said tubing section is axially compressed and slidably telescopically received inside said conduit.

50. The heated flowable material applicator of claim 21 wherein said tubing section is corrugated.

* * * * *